United States Patent [19]

Kurematsu et al.

[11] Patent Number: 4,537,856

[45] Date of Patent: Aug. 27, 1985

[54] METHOD OF PROCESSING SILVER HALIDE COLOR PHOTOGRAPHIC MATERIALS

[75] Inventors: Masayuki Kurematsu, Hachioji; Shigeharu Koboshi, Sahamihara, both of Japan

[73] Assignee: Konishiroku Photo Industry Co., Ltd., Tokyo, Japan

[21] Appl. No.: 596,871

[22] Filed: Apr. 5, 1984

[30] Foreign Application Priority Data

Apr. 5, 1983 [JP] Japan ..... 58-58692
Apr. 7, 1983 [JP] Japan ..... 58-59980

[51] Int. Cl.[3] ..... G03C 7/40

[52] U.S. Cl. ..... 430/372; 430/430; 430/432; 430/552; 430/553; 430/393

[58] Field of Search ..... 430/372, 432, 430, 418, 430/552, 553, 393

[56] References Cited

U.S. PATENT DOCUMENTS

| | | | |
|---|---|---|---|
| 3,335,004 | 8/1967 | Wrisley et al. | 430/372 |
| 4,083,721 | 4/1978 | Inouye et al. | 430/552 |
| 4,336,324 | 6/1982 | Koboshi et al. | 430/372 |
| 4,454,225 | 6/1984 | Sakai et al. | 430/553 |

*Primary Examiner*—Mary F. Downey
*Attorney, Agent, or Firm*—Bierman, Peroff & Muserlian

[57] ABSTRACT

A method of processing a silver halide color photographic material is disclosed. The material is treated with a bleach-fixing solution or a fixing solution, and then, without washing with water, treated with a stabilizing solution incorporating a water-soluble chelate compound of at least one metal selected from the group consisting of Ba, Ca, Ce, Co, In, La, Mn, Ni, Pb, Ti, Sn, Zn and Zr and the group consisting of Mg, Al and Sr.

23 Claims, No Drawings

METHOD OF PROCESSING SILVER HALIDE COLOR PHOTOGRAPHIC MATERIALS

BACKGROUND OF THE INVENTION

1. Field of the Invention

The present invention relates to a method of processing a silver halide color photographic material (hereunder referred to as a photographic material), and more particularly, to a stabilizing process that involves no step of washing with water subsequent to a desilvering step.

2. Description of the Prior Art

Photofinishers capable of automatic and continuous development of photographic materials are in current use. However, in order to prevent water pollution while at the same time saving valuable water resources, it is desired to reduce or eliminate the use of water in the washing step that follows the treatment with a fixing solution or a bleach-fixing solution. Therefore, several methods have been proposed for stabilizing the fixed or bleach-fixed photographic material without washing it with water. Japanese Patent Applications (OPI) Nos. 8542/82, 132146/82, 14834/82 and 18631/83 (the symbol OPI as used herein means an unexamined published Japanese patent application) show the use of stabilizing solutions containing isothiazoline derivatives, benzisothiazoline derivatives, polyaminocarboxylic acid soluble iron complex salts or organophosphonic acids.

However, these techniques are not highly effective in preventing the deterioration of an image, especially an increased yellow stain in the uncolored area, due to the fixing or bleach-fixing component that is carried over into the stabilizing solution by the photographic material in an amount that increases as the image storage time is extended. In particular, if an organic acid iron (III) complex salt used as a bleaching agent is left in the stabilizing solution, the dye image may be sufficiently protected from discoloration but is subject to appreciable yellow staining. This is particularly true if a relatively small amount of make-up stabilizer is used. Furthermore, the increase in the fixing component and the soluble silver complex salt in the stabilizing solution has been found to decrease the light stability of a cyan dye (i.e. the resistance to light discoloration).

SUMMARY OF THE INVENTION

Therefore, one object of the present invention is to provide a method of processing a photographic material in which the amount of a make-up stabilizer for the stabilizing solution used in the stabilizing step is significantly reduced.

Another object of the present invention is to provide a method of processing a photographic material with a stabilizing solution of improved time-dependent stability, wherein a thiosulfate or its soluble silver complex salt that is carried over into the stabilizing solution from the preceding bath experiences less decomposition into silver sulfide.

These and other objects of the present invention will become apparent by reading the following description.

According to the method of the present invention, a photographic material that has been treated with a bleach-fixing solution or a fixing solution is immediately (without washing with water) treated with a stabilizing solution incorporating a water-soluble chelate compound of at least one metal selected either from the group consisting of Ba, Ca, Ce, Co, In, La, Mn, Ni, Pb, Ti, Sn, Zn and Zr, or from the group consisting of Mg, Al and Sr.

DETAILED DESCRIPTION OF THE INVENTION

The water-soluble chelate compound as incorporated in the stabilizing solution of the present invention is such that the ion of one of the metals listed above reacts with a chelating agent to form a water-soluble complex salt. Preferred chelating compounds are selected from among those which have the following formulas (I) to (VIII).

$$M_mP_mO_{3m} \quad \text{(I)}$$

(M: hydrogen, alkali metal or ammonium; m: an integer of 3–6);

$$M_{n+2}P_nO_{3n+1} \quad \text{(II)}$$

(n: an integer of 2–20);

$$A_1—R_1—Z—R_2—COOH \quad \text{(III)}$$

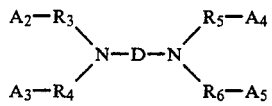

(IV)

wherein D is a substituted or unsubstituted alkylene group, cycloalkylene group, phenylene group, $—R_7OR_7—$, $—R_7OR_7OR_7—$ or $—R_7ZR_7—$ (wherein Z is $>N—R_7—A_6$ or $>N—A_6$; $R_7$ is a substituted or unsubstituted alkylene group; and $A_6$ is hydrogen, —OH, —COOM, or $—PO_3M_2$, M being a hydrogen atom, an alkali metal atom or ammonium); $R_1$ to $R_6$ are each the same as $R_7$; and $A_1$ to $A_5$ are each the same as $A_6$;

$$R_8N(CH_2PO_3M_2)_2 \quad \text{(V)}$$

wherein $R_8$ is a lower alkyl group, aryl group, aralkyl group, nitrogen-containing 6-membered cyclic group (which may be substituted by —OH, —OR or —COOM); M is a hydrogen atom, alkali metal atom or ammonium;

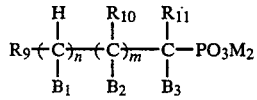

(VI)

wherein $R_9$ to $R_{11}$ are each a hydrogen atom, —OH, or a lower alkyl group (either unsubstituted or substituted by —OH, —COOM or $—PO_3M_2$); $B_1$ to $B_3$ are each a hydrogen atom, —OH, —COOM, $—PO_3M_2$ or $—NJ_2$ (J is a hydrogen atom, a lower alkyl, $C_2H_4OH$ or $—PO_3M_2$); M is a hydrogen atom, alkali metal or ammonium; m and n are each 0 or 1;

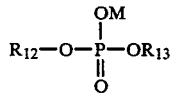

(VII)

wherein $R_{12}$ and $R_{13}$ are each a hydrogen atom, an alkali metal, ammonium, an alkyl group having 1 to 12 carbon atoms, an alkenyl group or a cyclic alkyl group;

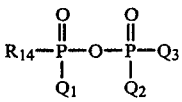

(VIII)

wherein $R_{14}$ is an alkyl group having 1 to 12 carbon atoms, an alkoxy group having 1 to 12 carbon atoms, a monoalkylamino group having 1 to 12 carbon atoms, a dialkylamino group having 2 to 12 carbon atoms, an amino group, an aryloxy group having 1 to 24 carbon atoms, an arylamino group having 6 to 24 carbon atoms, or an amyloxy group; $Q_1$ to $Q_3$ each represents —OH, an alkoxy group having 1 to 24 carbon atoms, an aralkyloxy group, aryloxy group, —$OM_3$ (M is a cation), amino group, morpholino group, cyclic amino group, alkylamino group, dialkylamino group, arylamino group or alkyloxy group.

Chelate compounds other than those represented by the formulas (I) to (VIII) may also be used, and they include 1-2-dihydroxybenzene-3,5-disulfonic acid and glycine. However, these compounds are not as effective as the compounds of formulas (I) to (VIII).

Specific examples of the compounds of the formulas (I) to (VIII) are listed below.

$Na_4P_4O_{12}$ (1)

$Na_3P_3O_9$ (2)

$H_4P_2O_7$ (3)

$H_5P_3O_{10}$ (4)

$Na_6P_4O_{13}$ (5)

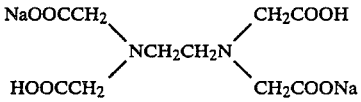

(6)

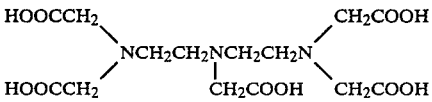

(7)

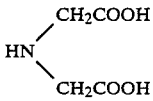

(8)

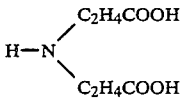

(9)

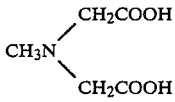

(10)

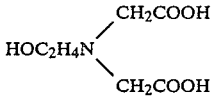

(11)

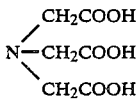

(12)

-continued

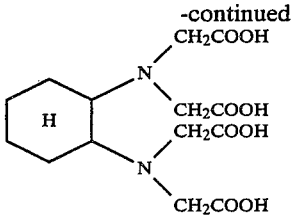

(13)

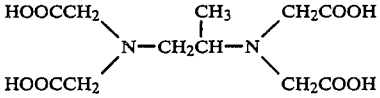

(14)

$(HOC_2H_4)_2NCH_2COOH$ (15)

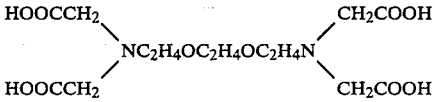

(16)

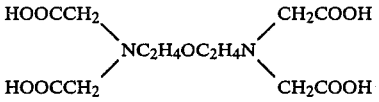

(17)

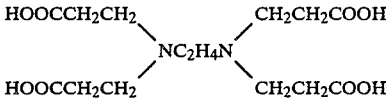

(18)

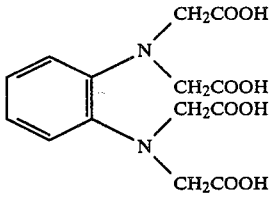

(19)

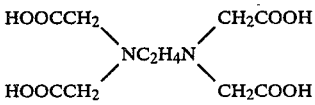

(20)

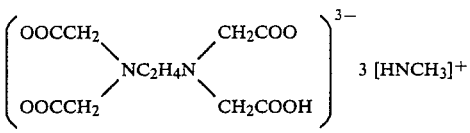

(21)

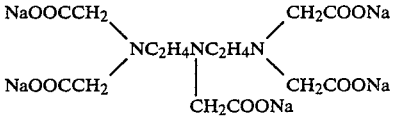

(22)

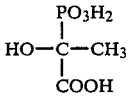

(23)

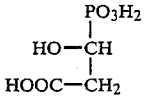

(24)

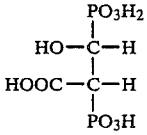

(25)

-continued
(26)
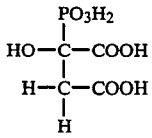
(27)
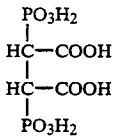
(28)
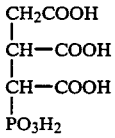
(29)
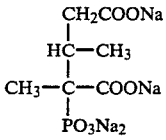
(30)
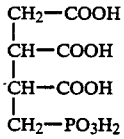
(31)
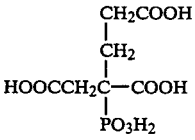
(32)
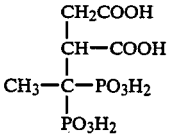
(33)
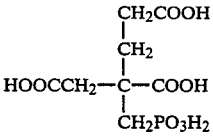
(34)
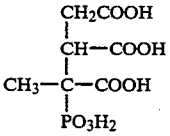
(35)
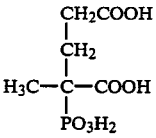
-continued
(36)
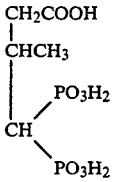
(37)
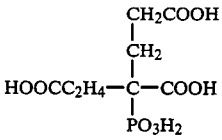
(38)
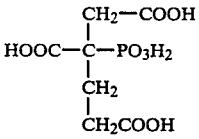
(39)
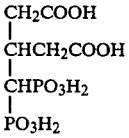
(40)
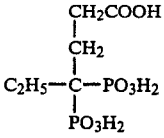
(41)
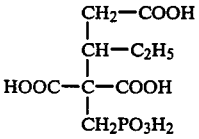
(42)
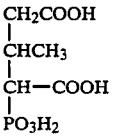
(43)
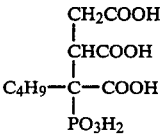
(44)
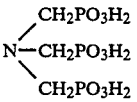
(45)
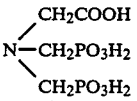
(46)
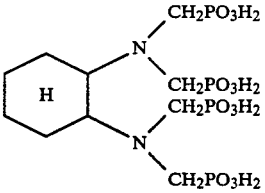

-continued
(47)
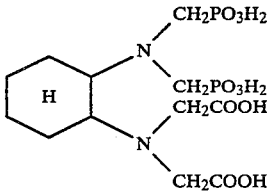
(48)
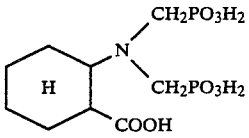
(49)
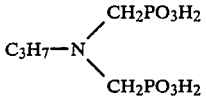
(50)
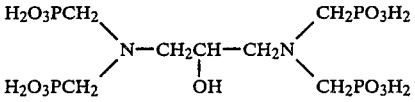
(51)
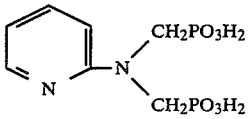
(52)
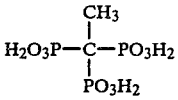
(53)
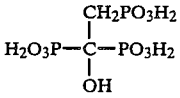
(54)
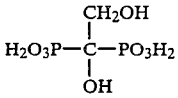
(55)
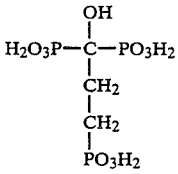
(56)
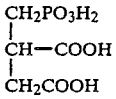
(57)
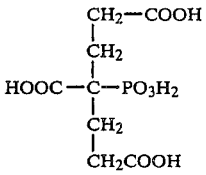
-continued
(58)
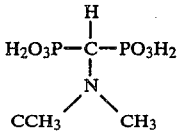
(59)
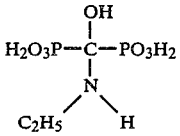
(60)
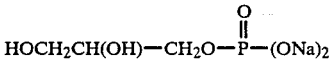
(61)
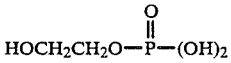
(62)
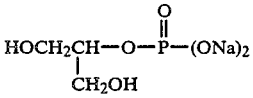
(63)
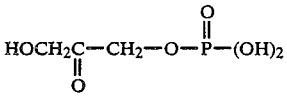
(64)
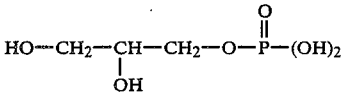
(65)
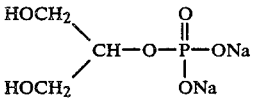
(66)
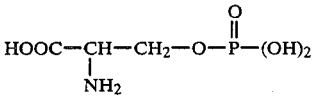
(67)
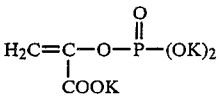
(68)
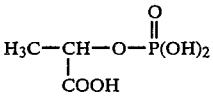
(69)
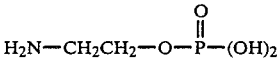
(70)
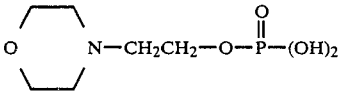
(71)
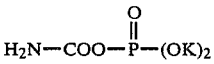
(72)
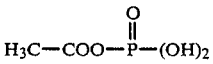

-continued (73)

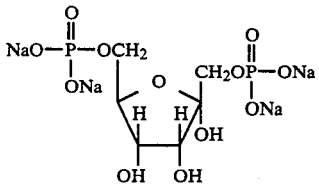

(74)

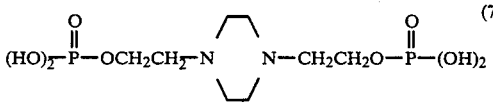

(75)

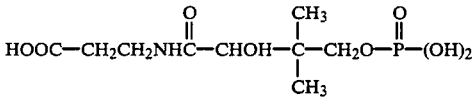

(76)

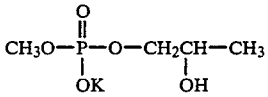

(77)

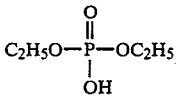

(78)

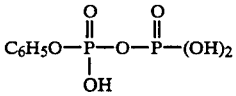

(79)

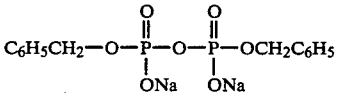

(80)

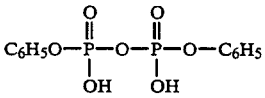

(81)

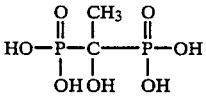

(82)

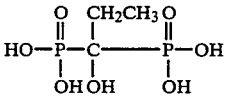

(83)

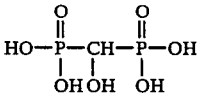

(84)

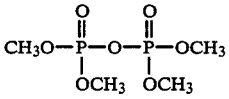

(85)

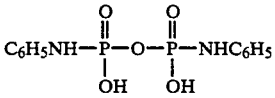

(86)

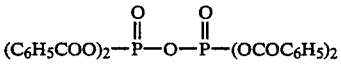

-continued (87)

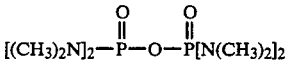

Chelating agents of the formula (VI) are more effective than those of the other formulas, and of the compounds of formula (VI), Compound No. 81 gives the best results. Chelating agents of formula (I) to (VIII) may be used either alone or in combination with themselves or with a compound of one formula may be combined with a compound of another formula.

The water-soluble chelate compound of at least one metal selected from the group consisting of Ba, Ca, Ce, Co, In, La, Mn, Ni, Pb, Ti, Sn, Zn and Zr may be used in an amount of $1\times10^{-4}$ to $1\times10^{-1}$ mol per liter of the stabilizing solution. The preferred amount ranges from $4\times10^{-4}$ to $2\times10^{-2}$ mol per liter of the stabilizing solution. A particularly preferred range is from $8\times10^{-4}$ to $1\times10^{-2}$ mol per liter of the stabilizing solution.

The water-soluble chelate compound of at least one metal selected from the group consisting of Mg, Al and Sr may be used in an amount generally ranging from $1\times10^{-4}$ to $3.5\times10^{-2}$ mol, preferably from $5\times10^{-4}$ to $3\times10^{-2}$ mol, more preferably from $1\times10^{-3}$ to $2\times10^{-2}$ mol, per liter of the stabilizing bath. If less than $1\times10^{-4}$ mol of the chelate compound is used per liter of the stabilizing bath, the intended objects of the present invention cannot be attained. If more than $3.5\times10^{-2}$ mol of the chelate compound is used per liter of the stabilizing bath, tiny crystal grains may form on the surface of an emulsion layer drying, or the image may undergo yellow staining.

Preferred metallic ions that should be selected from the first group of metals are Ba, Ca, Sn, Zn and Zr ions. A preferred metallic ion that should be selected from the second group of metals is a Mg ion. Two or more metals may of course be used in the present invention.

Compounds which are the same as the chelate compounds that are to be deliberately incorporated in the stabilizing solution may naturally occur in the water used to make the stabilizing solution, but their content is so small that such naturally occurring compounds are not all effective in attaining the objects of the present invention.

The water-soluble chelate compound according to the present invention may be incorporated in the stabilizing solution by one of the following two methods: a metal salt or metallic ion and a chelating agent are separately added to the stabilizing solution; or said compound may be added in the form of a metal chelating compound. The latter method is preferred.

The amount of the chelating agent as against the metal is not critical in the present invention so long as the metallic ion does not form a precipitate (e.g. hydroxide) in the stabilizing solution. The chelating agent is preferably used in a more-than-equimolar amount.

When a cyan coupler of the following formula (C-I) or (C-II) is incorporated in the silver halide photographic material of the present invention, an additional advantage results in that the cyan dye produced by color development has an improved resistance to light.

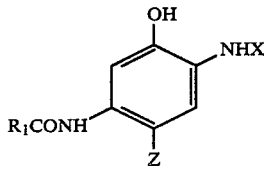

(C-I)

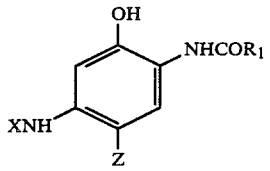

(C-II)

wherein X is $—COR_2$,

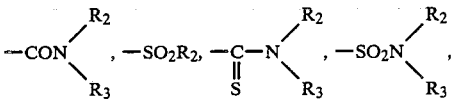

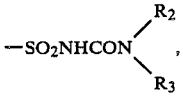

$—CONHCOR_2$ or $—CONHSO_2R_2$ (wherein $R_2$ is an alkyl group, alkenyl group, cycloalkyl group, aryl group or a hetero ring; $R_3$ is a hydrogen atom, an alkyl group, alkenyl group, cycloalkyl group, aryl group or a hetero ring, provided that $R_2$ and $R_3$ may combine to form a 5- or 6-membered ring); $R_1$ is a ballast group; Z is a hydrogen atom or a group that is capable of leaving upon coupling with the oxidized product of an aromatic primary aminecolor developing agent.

The group $R_2$ in X of formula (C-I) or (C-II) is an alkyl group (preferably an alkyl group having 1 to 20 carbon atoms, such as methyl, ethyl, t-butyl or dodecyl), an alkenyl group (preferably an alkenyl group having 2 to 20 carbon atoms, such as acyl or oleyl), a cycloalkyl group (preferably a 5- to 7-membered ring such as cyclohexyl), an aryl group (e.g. phenyl, tolyl or naphthyl), or a hetero cyclic group (preferably a 5- or 6-membered hetero ring having 1 to 4 nitrogen, oxygen or sulfur atoms, such as a furyl group, thienyl group or benzothiazolyl group). The symbol $R_3$ is either a hydrogen atom or the same as $R_2$, provided that $R_2$ and $R_3$ may combine to form a nitrogen-containing 5- or 6-membered hetero ring. The groups $R_2$ and $R_3$ may be unsubstituted or substituted. Illustrative substituents are an alkyl group having 1 to 10 carbon atoms (e.g. ethyl, i-propyl, i-butyl, t-butyl or t-octyl), an aryl group (e.g. phenyl or naphthyl), a halogen atom (e.g. F, Cl or Br), a cyano group, nitro group, sulfonamido group (e.g. methanesulfonamide, butanesulfonamide or p-toluenesulfonamide), a sulfamoyl group (e.g. methylsulfamoyl or phenylsulfamoyl), a sulfonyl group (e.g. methanesulfonyl or p-toluenesulfonyl), a fluorosulfonyl group, a carbamoyl group (e.g. dimethylcarbamoyl or phenylcarbamoyl), an oxycarbonyl group (e.g. ethoxycarbonyl or phenoxycarbonyl), an acyl group (e.g. acetyl or benzoyl), a heterocyclic group (e.g. pyridyl or pyrazolyl group), an alkoxy group, an aryloxy group or an acyloxy group.

The group $R_1$ in the formulas (C-I) and (C-II) represents a ballast group that imparts anti-diffusing property to the cyan coupler of formula (C-I) or (C-II), as well as the cyan dye formed from such coupler. Preferred ballast groups are an alkyl group having 4 to 30 carbon atoms, an aryl group and a heterocyclic group. More specifically, a straight-chain or branched alkyl group (e.g. t-butyl, n-octyl, t-octyl or n-dodecyl), an alkenyl group, a cycloalkyl group and a 5- or 6-membered heterocyclic group.

The symbol Z in the formulas (C-I) and (C-II) represents a hydrogen atom or a group that is capable of leaving upon coupling with the oxidized product of an aromatic primary amine color developing agent. Examples of such leaving group include a halogen atom (e.g. Cl, Br or F atom), as well as an aryloxy group, carbamoyloxy group, a carbamoylmethoxy group, acyloxy group, sulfonamido group or succinimido group having an oxygen or nitrogen atom directly bonded to a coupling site. More specific examples are shown in U.S. Pat. No. 3,741,563, Japanese Patent Application (OPI) No. 37425/72, Japanese Patent Publication No. 36894/73, Japanese Patent Applications (OPI) Nos. 10135/75, 117422/75, 130441/75, 108841/76, 120334/75, 18315/77, 105226/78, 14736/79, 48237/79, 32071/80, 65957/80, 1938/81, 12643/81 and 27147/81.

Particularly preferred cyan couplers are those having the following formulas (XIV), (XV) and (XVI).

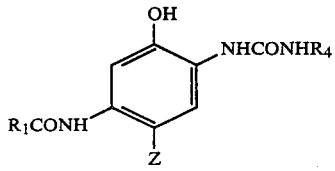

(XIV)

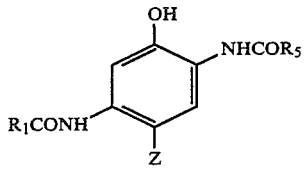

(XV)

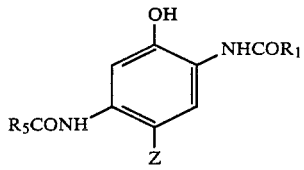

(XVI)

In the formula (XIV), $R_4$ represents a substituted or unsubstituted aryl group (preferably a phenyl group). The aryl group may be substituted by at least one member selected from among $—SO_2R_6$, halogen atom (e.g. Cl, Br or F), $—CF_3$, $—NO_2$, —CN, $—COR_6$, $—COOR_6$, $—SO_2OR_6$,

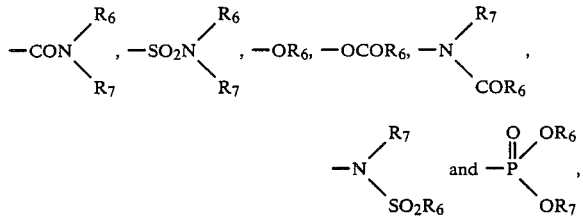

wherein R is an alkyl group (preferably an alkyl having 1 to 20 carbon atoms, such as methyl, ethyl, tertbutyl or dodecyl), an alkenyl group (preferably an alkenyl group having 2 to 20 carbon atoms, such as acyl or oleyl), a cycloalkyl group (preferably a 5- to 7-membered ring such as cyclohexyl group), or an aryl group (e.g. phenyl, tolyl or naphthyl), and $R_7$ is a hydrogen atom or the same as $R_6$.

Preferred phenolic cyan couplers of the formula (XIV) are such that $R_4$ is an unsubstituted phenyl group or a phenyl group substituted by cyano, nitro, $—SO_2R_6$ ($R_6$ being an alkyl group), halogen atom or trifluoromethyl.

In the formulas (XV) and (XVI), $R_5$ represents an alkyl group (preferably an alkyl group having 1 to 20 carbon atoms, such as methyl, ethyl, tert-butyl or dodecyl), an alkenyl group (preferably an alkenyl group having 2 to 20 carbon atoms, such as acyl or oleyl), a cycloalkyl group (preferably a 5- to 7-membered ring such as cyclohexyl), an aryl group (e.g. phenyl, tolyl or naphthyl), or a heterocyclic group (preferably a 5- or 6-membered hetero ring having 1 to 4 nitrogen, oxygen or sulfur atoms, such as furyl, thienyl or benzothiazolyl group).

The groups $R_6$ and $R_7$ in formula (XIV) and $R_5$ in formulas (XV) and (XVI) may be substituted by any of the groups that are listed as substituents which can be introduced into $R_2$ or $R_3$ in formulas (C-I) and (C-II). A particularly preferred substituent is a halogen atom (e.g. Cl or F atom).

The symbols Z and $R_1$ in the formulas (XIV), (XV) and (XVI) have the same meanings as defined for the formulas (C-I) and (C-II). A preferred example of the ballast group as $R_1$ is represented by formula (XVII):

(XVII)

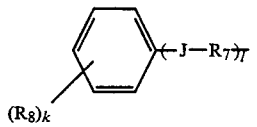

wherein J is an oxygen atom, sulfur atom or a sulfonyl group; k is an integer of 0 to 4; l is 0 or 1; when k is 2 or more, $R_8$ may be the same or different; $R_7$ is a straight-chain or branched alkylene group having 1 to 20 carbon atoms, or an alkylene group substituted by an aryl group or the like; $R_8$ is a monovalent group such as a hydrogen atom, a halogen atom (preferably Cl or Br), an alkyl group (preferably a straight-chain or branched alkyl group having 1 to 20 carbon atoms, such as methyl, t-butyl, t-pentyl, t-octyl, dodecyl, pentadecyl, benzyl or phenetyl), an aryl group (e.g. phenyl), a heterocyclic group (preferably a nitrogen-containing heterocyclic group), an alkoxy group (preferably a straight-chain or branched alkoxy group having 1 to 20 carbon atoms, such as methoxy, ethoxy, t-butyloxy, octyloxy, decyloxy or dodecyloxy), an aryloxy group (e.g. phenoxy), a hydroxyacyloxy group (preferably an alkylcarbonyloxy group or an arylcarbonyloxy group such as acetoxybenzoyloxy), a carboxyalkyloxycarbonyl group (preferably a straight-chain or branched alkyloxycarbonyl group having 1 to 20 carbon atoms), an aryloxycarbonyl group (preferably phenoxycarbonyl), an alkylthio group (preferably having 1 to 20 carbon atoms), an acyl group (preferably a straight-chain or branched alkylcarbonyl group having 1 to 20 carbon atoms), an acylamino group (preferably a straight-chain or branched alkylcarboamido having 1 to 20 carbon atoms or a benzenecarboamido), a sulfonamido group (preferably a straight-chain or branched alkylsulfonamido group having 1 to 20 carbon atoms or a benzenesulfonamido group), a carbamoyl group (preferably a straight-chain or branched alkylaminocarbonyl group or having 1 to 20 carbon atoms, or a phenyl aminocarbonyl group), or a sulfamoyl group (preferably a straight-chain or branched alkylaminosulfonyl group having 1 to 20 carbon atoms, or a phenylaminosulfonyl group).

Specific examples of the cyan couplers that can be used in the present invention are listed below.

(C-1)

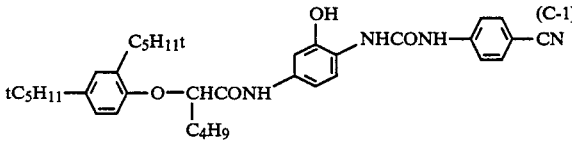

(C-2)

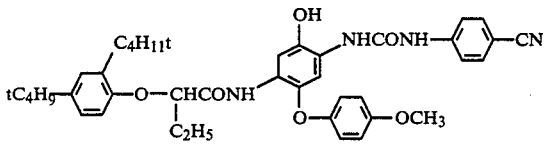

(C-3)

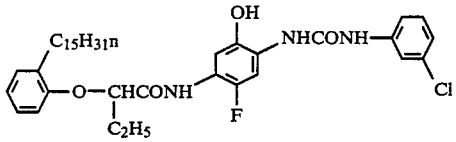

(C-4)

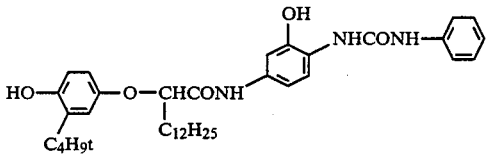

(C-5)

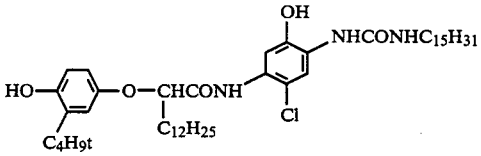

(C-6)

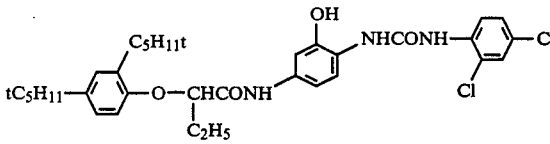

(C-7)

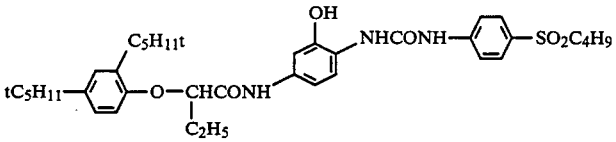

-continued
(C-8)
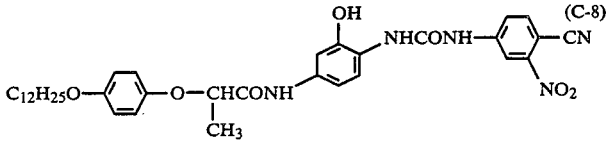
(C-9)
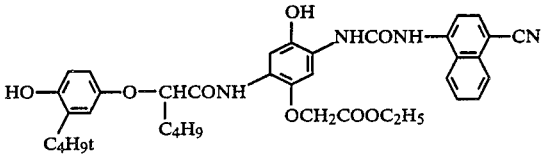
(C-10)
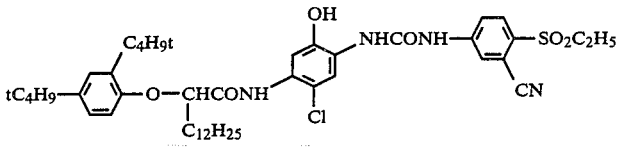
(C-11)
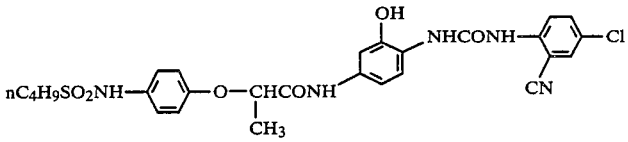
(C-12)
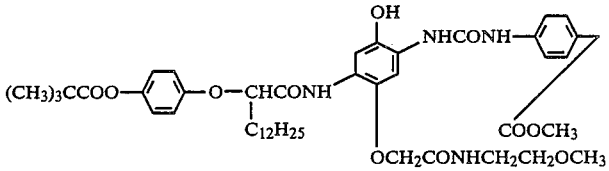
(C-13)
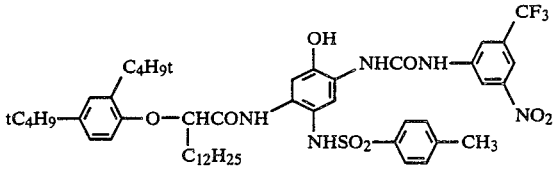
(C-14)
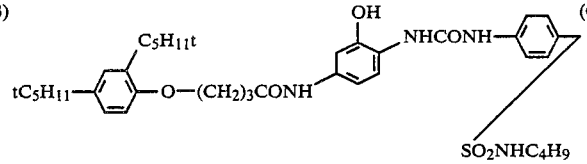
(C-15)
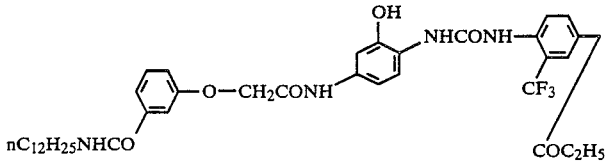
(C-16)
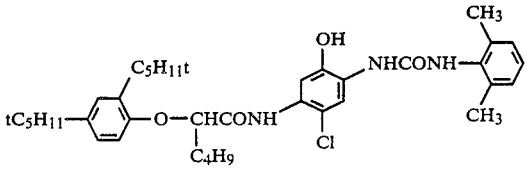
(C-17)
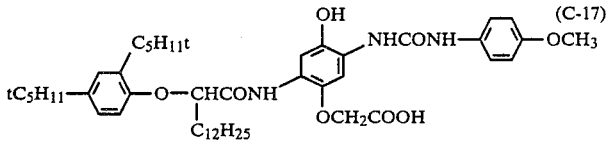
(C-18)
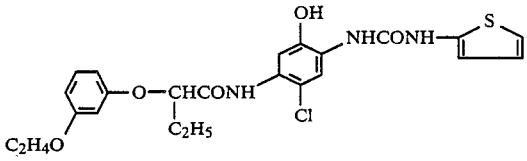
(C-19)
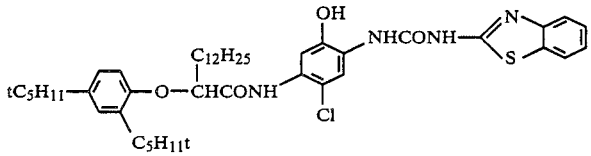
(C-20)
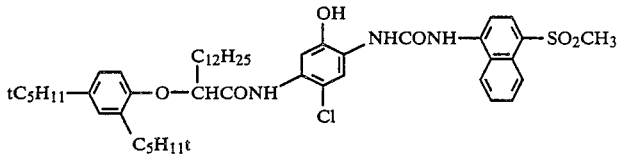

-continued
(C-21)
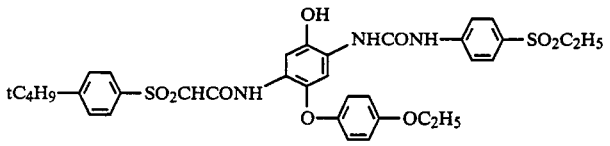
(C-22)
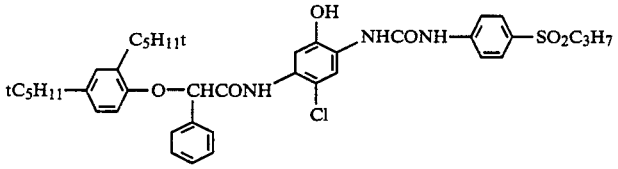
(C-23)
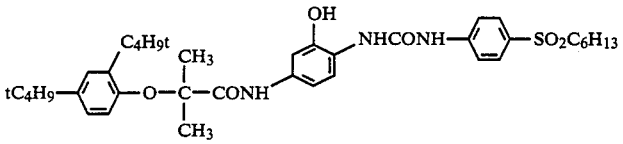
(C-24)
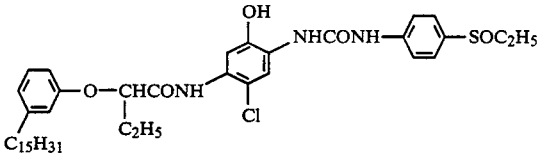
(C-25)
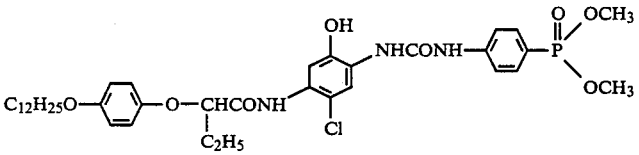
(C-26)
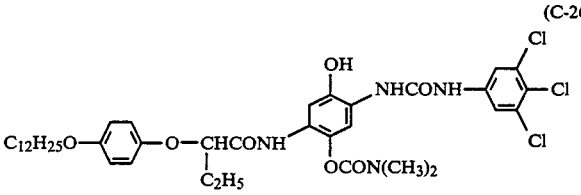
(C-27)
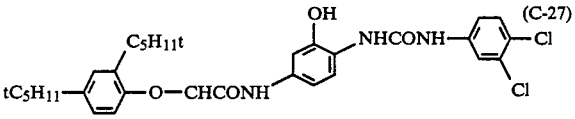
(C-28)
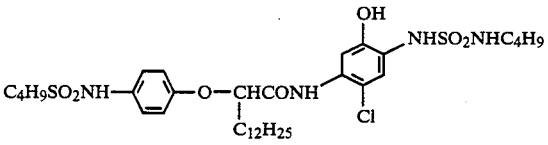
(C-29)
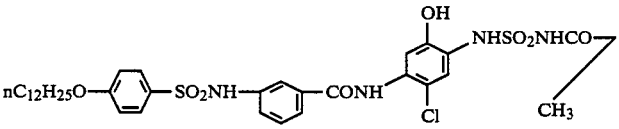
(C-30)
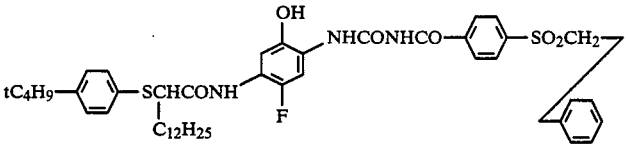

-continued
(C-31)
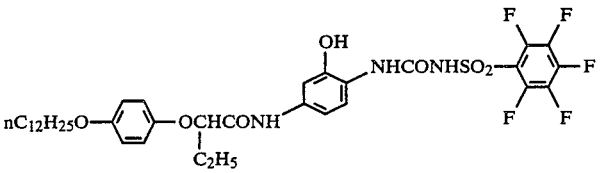
(C-32)
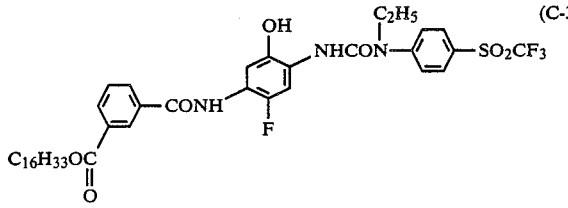
(C-33)
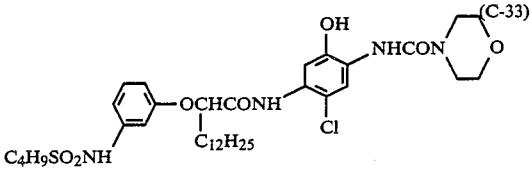
(C-34)
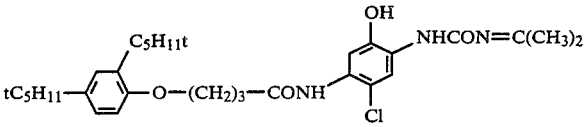
(C-35)
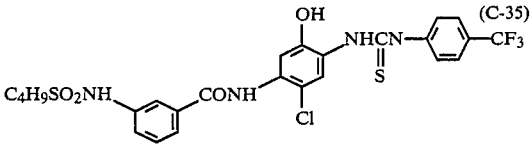
(C-36)
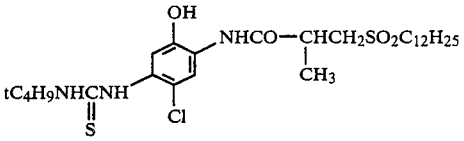
(C-37)
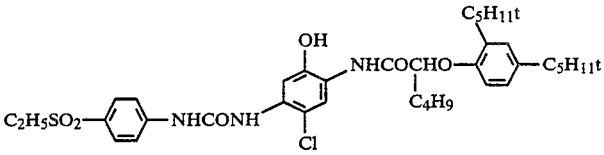
(C-38)
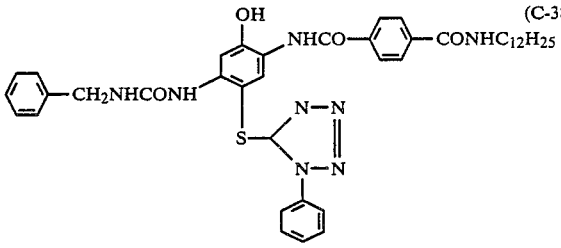
(C-39)
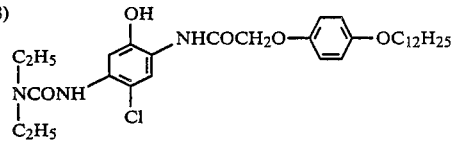
(C-40)
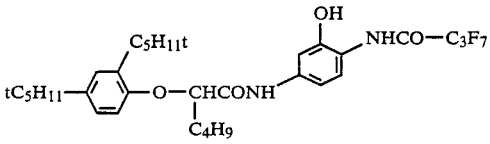
(C-41)
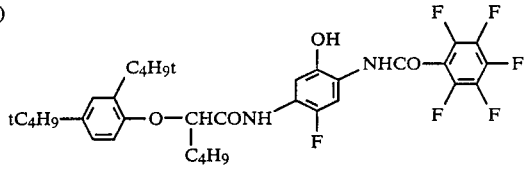
(C-42)
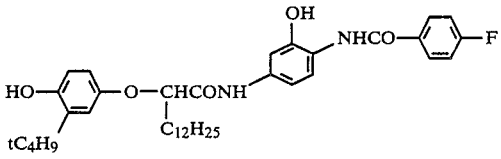
(C-43)
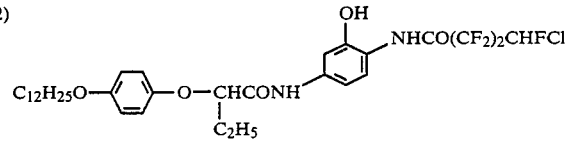
(C-44)
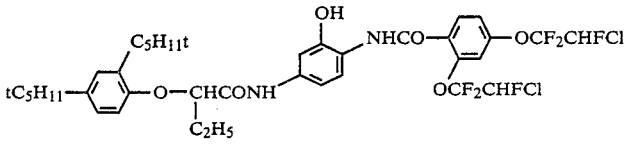
(C-45)
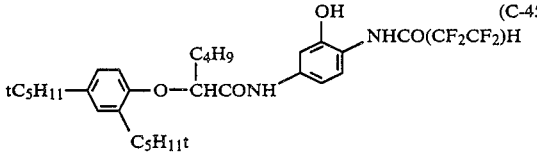
(C-46)
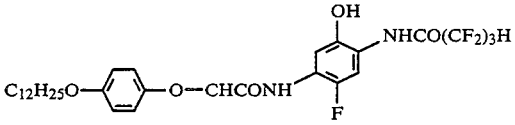

-continued
(C-47)
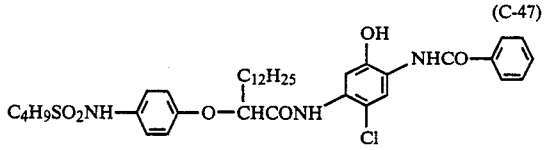
(C-48)
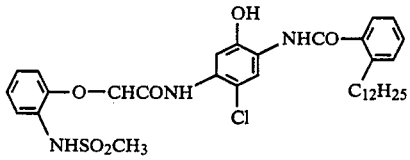
(C-49)
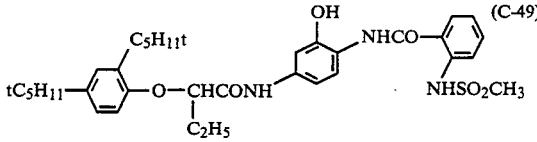
(C-50)
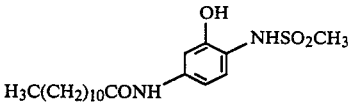
(C-51)
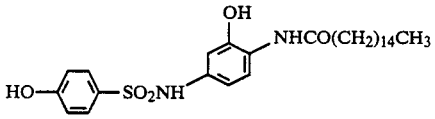
(C-52)
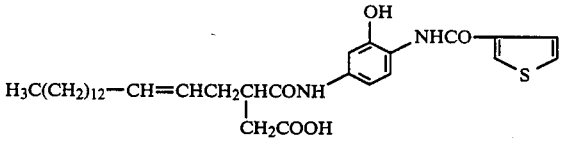
(C-53)
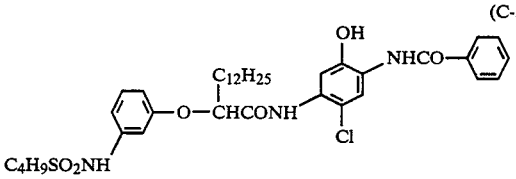
(C-54)
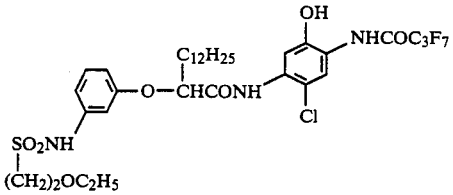
(C-55)
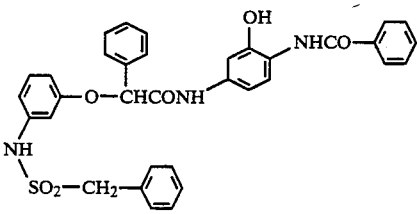
(C-56)
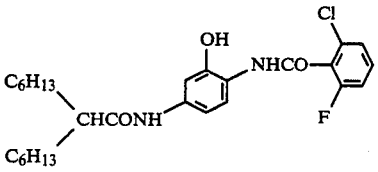
(C-57)
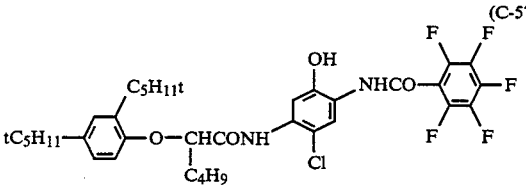
(C-58)
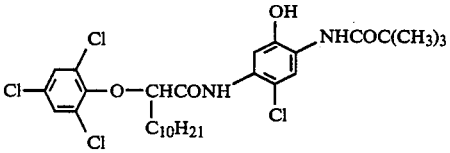
(C-59)
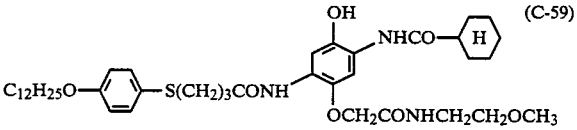
(C-60)
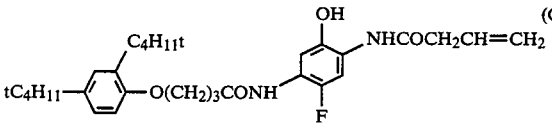
(C-61)
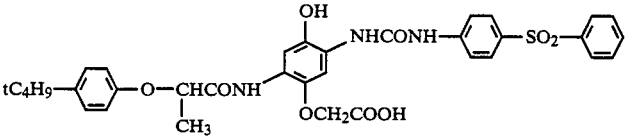
(C-62)
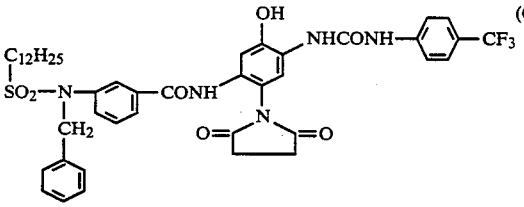
(C-63)
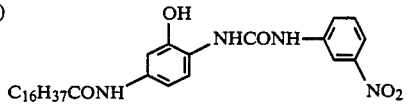

-continued (C-64)

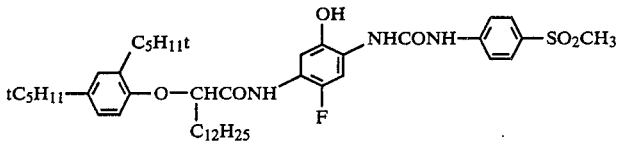

(C-65)

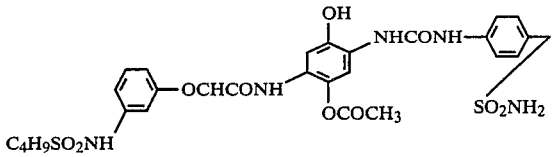

(C-66)

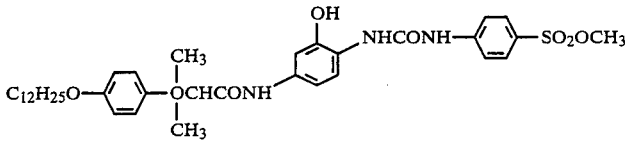

(C-67)

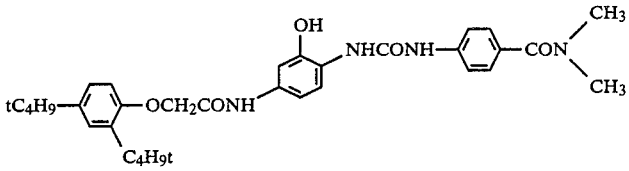

(C-68)

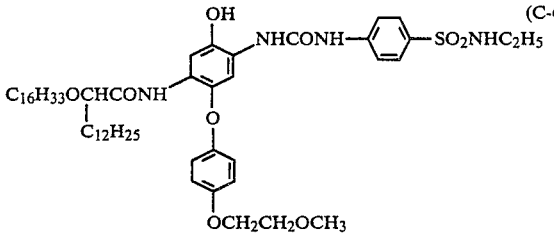

(C-69)

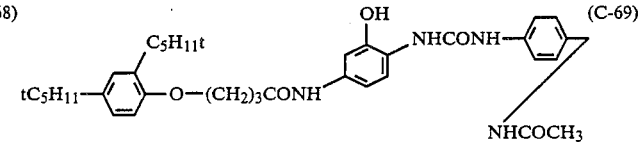

The pH of the stabilizing solution used in the present invention is not critical. Preferably, it has a pH in the range of 0.5 to 10.0, more preferably from 3.0 to 9.0, and particularly preferably from 6.0 to 8.0. The stabilizing solution is desirably buffered by a pH buffer. The buffering action is known to be provided by solutions containing mixtures (salts) of weak acids and strong bases or weak bases and strong acids. Illustrative acid salts include acetates, borates, metaborates, phosphates, monocarboxylates, dicarboxylates, polycarboxylates, oxycarboxylates, amino acid salts, aminocarboxylates, primary phosphates, secondary phosphates and tertiary phosphates.

The stabilizing solution according to the present invention may incorporate any other known additives such as brighteners, surfactants, mold inhibitors, antiseptics, organosulfur compounds, onium salts, and formalin. Any of these compounds may be used in any combinations to the extent that the desired pH of the stabilizing bath is maintained and that the color photographic image produced can be held stable without causing any unwanted precipitation.

Other compounds that are desirably incorporated in the stabilizing solution according to the present invention include pH modifiers such as acetic acid, sulfuric acid, hydrochloric acid, sulfanilic acid, potassium hydroxide, sodium hydroxide and ammonium hydroxide; mold inhibitors such as sodium benzoate, butyl hydroxybenzoate, antibiotics, dehydroacetic acid, potassium sorbate, thiabendazole and ortho-phenylphenol; preservatives such as 5-chloro-2-methyl-4-isothiazoline-3-one, 2-octyl-4-isothiazoline-3-one, 1-2-benzisothiazoline-3-one, and water-soluble bismuth compounds; dispersants such as ethylene glycol, polyethylene glycol and polyvinyl pyrrolidone; hardeners such as formalin; and brighteners.

The treatment with the stabilizing solution of the present invention is generally performed at a temperature in the range of 15° and 60° C., preferably in the range of 20° to 45° C. Since rapid processing is preferred, the stabilization is generally performed in a period of 20 seconds to 10 minutes, and most preferably, it is performed in a period of 1 to 5 minutes. If a plurality of stabilization tanks are used, the retention time of the photograhic material being processed in the tanks closer to the fixing or bleach-fixing bath is preferably shorter than that in the tanks closer to the drying step. It is particularly preferred that the retention time in a specific stabilizing tank is 20 to 50% longer than that in the preceding stabilizing tank. In a multistage stabilization process, the make-up stabilizer is preferably fed into the final tank so that it overflows into successive tanks in the reverse order. According to the present invention, the photographic material that has passed through the stabilizing step need not be washed with water at all. However, if required, rinsing with a small amount of water or the washing of the surface of the photographic material may be effected only for a very short period of time.

The bleach-fixing bath or fixing bath used in the present invention may employ and kind of bleaching agent, but particularly good results are obtained with an organic acid iron (III) complex salt. The type of the fixing solution is also not critical, but particularly good results are obtained with a thiosulfate. It is most effective to use a fixing bath or a bleach-fixing bath containing both an organic acid iron (III) complex salt and a thiosulfate.

The stabilizing solution of the present invention may be brought into contact with the photographic material by immersing the latter in the stabilizing solution, as is usually performed with other processing solutions. If desired, a sponge or a synthetic fiber cloth may be used to apply the stabilizing solution onto the surface of the emulsion layer in the photographic material or both sides of a transport leader, or the surface of a transport belt on which the photographic material rests. Alternatively, the stabilizing solution may be sprayed onto any one of these surfaces.

The method of the present invention may be used to process any photographic materials such as color paper, reversal color paper, color positive film, color negative film, color reversal film and color X-ray film.

If the stabilizing solution of the present invention contains a soluble silver salt, the former may be subjected to silver recovery. Silver can be recovered with an ion exchange resin, or by metal displacement, electrolysis or silver sulfide precipitation may be employed.

The photographic material that is to be processed by the present invention may be of the coupler-in-emulsion type as shown in U.S. Pat. Nos. 2,376,679 and 2,801,171, or of the coupler-in-developer type as shown in U.S. Pat. Nos. 2,252,718, 2,592,243 and 2,590,970. Couplers other than the cyan couplers listed above may also be used, and they are well known to those skilled in the art. Suitable magenta couplers are those having as the basic structure a 5-pyrazolone ring with an active methylene group. Suitable yellow couplers are those having as the basic structure benzoyl acetanilide, pivalyl acetanilide or acyl acetanilide with an active methylene chain. Magenta couplers and yellow couplers may or may not have a substituent at the coupling site. Either 2-equivalent or 4-equivalent couplers may be used. Any of the conventional silver halides may be used in the silver halide emulsion, and they include silver chloride, silver bromide, silver iodide, silver chlorobromide, silver chloroiodide, silver iodobromide and silver chloroiodobromide. These sliver halides may be protected by natural colloids such as gelatin or by any of the synthetic colloids. The silver halide emulsion may contain any of the conventional photographic addenda such as stabilizers, sensitizers, hardeners, sensitizing dyes and surfactants.

Any conventional support may be used and typical examples include polyethylene coated paper, triacetate film, polyethylene terephthalate film and white polyethylene terephthalate film.

The method of the present invention uses a black-and-white developer, which may be a "first black-and-white developer" conventionally used in the processing of color photographic materials, or any of the developers that are used in the processing of black-and-white photographic materials. The black-and-white developer used in the present invention may contain a variety of additives commonly incorporated in black-and-white developers.

Typical additives that may be incorporated in the black-and-white developer include developing agents such as 1-phenyl-3-pyrazolidone, Metol and hydroquinone; preservatives such as sulfites; accelerators made of alkalis such as sodium hydroxide, sodium carbonate and potassium cabonate; inorganic or organic inhibitors such as potassium bromide, 2-methylbenzimidazole and methylbenzothiazole; water softeners such as polyphosphoric acid salts; and agents to prevent excessive surface development such as trace amounts of iodides or mercapto compounds.

The aromatic primary amine color developing agent incorporated in the color developer may be selected from many known compounds that are conventionally used in various color photographic processes. These compounds include aminophenolic and p-phenylenediamine derivatives, which are generally used in the form of salts, such as hydrochlorides or sulfates, which are more stable than when these compounds are in the free state. These developing agents are used in concentrations which generally range from about 0.1 g to about 30 g, preferably from about 1 g to about 15 g, per liter of the color developer. Illustrative aminophenolic developing agents are o-aminophenol, p-aminophenol, 5-amino-2-oxy-toluene, 2-amino-3-oxy-toluene and 2-oxy-3-amino-1,4-dimethylbenzene. Useful primary aromatic amino compounds are N,N-dialkyl-p-phenylenediamines, wherein the alkyl and phenyl groups may or may not be substituted. Particularly useful N,N-dialkyl-p-phenylenediamine compounds include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylanine, and 4-amino-N-(2-methoxyethyl)-N-ethyl-3-methylaniline-p-toluene sulfonate.

The alkaline color developing agent used in the method of the present invention may contain any additives other than the primary aromatic amine developing agent, and such optional additives include alkali agents (e.g. sodium hydroxide, sodium carbonate and potassium carbonate), alkali metal sulfites, alkali metal bisulfites, alkali metal thiocyanates, alkali metal halides benzyl alcohol, water softeners and thickeners. The color developer used in the present invention is generally adjusted to a pH of 7.0 or more, and most typically, to a pH in the range of from about 10 to about 13. As will be apparent from the foregoing description and from the working examples shown below, the method of the present invention uses a lesser amount of the make-up stabilizer for the stabilizing solution, and yet the image formed is resistant to yellow staining even after extended storage of the photographic material processed. Furthermore, the stabilizing solution used in the present invention has an excellent long-term stability because the decomposition to silver sulfide of a thiosulfate and its soluble silver complex salt that are carried over from the preceding bath is held minimum and the formation of an unwanted precipitate is effectively prevented.

The advantages of the present invention are hereunder described in greater detail by reference to the following examples which are given here for illustrative purposes only and are by no means intended to limit the scope of the present invention.

EXAMPLE 1

Samples of photographic material were prepared by sequentially applying the layers listed below to a support made of polyethylene coated paper. The support was prepared by the following procedure. Two hundred parts by weight of a polyethylene having an average molecular weight of 100,000 and a density of 0.95 was mixed with 20 parts by weight of a polyethylene having an average molecular weight of 2,000 and a density of 0.80. To the mixture, 6.8 wt% of titanium oxide of anatase type was added. The resulting mix was extruded onto the surface of quality paper (basis weight: 170 g/m$^2$) to form a coat in a thickness of 0.035 mm. The back side of the paper was provided with a coat 0.040 mm thick that was extruded from only the polyethylene mixture (no $TiO_2$). Before application of the following layers, the obverse face of the support was treated with corona discharge.

First layer:

This was a blue-sensitive silver halide emulsion layer comprising a silver chlorobromide emulsion containing 95 mol% silver bromide. The emulsion contained 350 g of gelatin per mol of the silver halide and was sensitized with $2.5\times10^{-4}$ mol, per mol of the silver halide, of a sensitizing dye of the following structure:

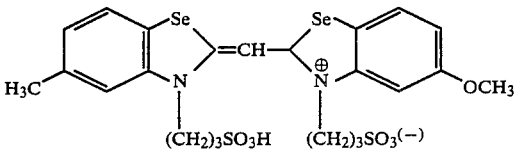

For the sensitization purpose, isopropyl alcohol was used as a solvent. The emulsion also contained 2,5-di-t-butyl hydroquinone as dispersed in dibutyl phthalate, and $2\times10^{-1}$ mol, per mol of the silver halide, of a yellow coupler, i.e. α-[4-(1-benzyl-2-phenyl-3,5-dioxo-1,2,4-triazolidyl)]-α-pivalyl-2-chloro-5-[γ-(2,4-di-t-amylphenoxyl)butylamido]acetanilide. The silver deposit was 350 mg/m$^2$.

Second layer:

This was a gelatin layer containing 300 mg/m$^2$ of di-t-octyl-hydroquinone dispersed in dibutyl phthalate, and 200 mg/m$^2$ of a UV absorber which was a mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3',5'-di-t-butylphenyl)-5-chlorobenzotriazole. The gelatin deposit was 2,000 mg/m$^2$.

Third layer:

This was a green-sensitive silver halide emulsion layer comprising a silver chlorobromide emulsion containing 85 mol% silver bromide. The emulsion contained 450 g of gelatin per mol of the silver halide and was sensitized with $2.5\times10^{-4}$ mol, per mol of the silver halide, of a sensitizing dye of the following structure:

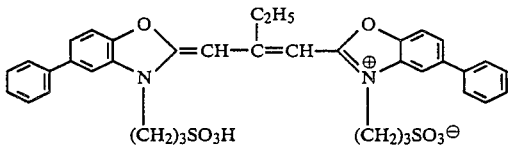

The emulsion also contained 2,5-di-t-butyl hydroquinone dispersed in a 2:1 mixed solvent of dibutyl phthalate and tricresyl phosphate, and $1.5\times10^{-1}$ mol, per mol of the silver halide, of a magenta coupler, i.e. 1-(2,4,6-trichlorophenyl)-3-(2-chloro-5-octadecenylsuccinimidoanilino)-5-pyrazolone. The silver deposit was 300 mg/m$^2$. This layer contained 0.3 mol, per mol of the coupler, of an antioxidant, i.e. 2,2,4-trimethyl-6-lauryloxy-7-t-octylchroman.

Fourth layer:

This was a gelatin layer containing 30 mg/m$^2$ of di-t-octylhydroquinone dispersed in dibutyl phthalate, and 500 mg/m$^2$ of a UV absorber which was a 2:1.5:1.5:2 mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole, and 2-(2'-hydroxy-3',5'-t-butylphenyl)-5-chloro-benzotriazole. The gelatin deposit was 2,000 mg/m$^2$.

Fifth layer:

This was a red-sensitive silver halide emulsion layer comprising a silver chlorobromide emulsion containing 85 mol% silver bromide. The emulsion contained 500 g of gelatin per mol of the silver halide, and was sensitized with $2.5\times10^{-4}$ mol, per mol of the silver halide, of a sensitizing dye of the following structure:

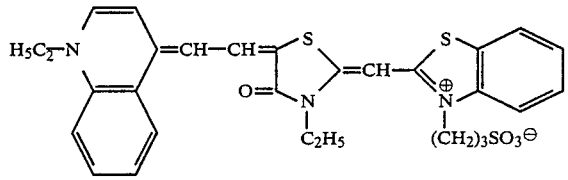

The emulsion also contained 2,5-di-t-butylhydroquinone as dispersed in dibutyl phthalate, and $3.5\times10^{-1}$ mol, per mol of the silver halide, of a cyan coupler, i.e. 2,4-dichloro-3-methyl-6-[γ-(2,4-diamylphenoxyl)-butylamido]phenol. The silver deposit was 270 mg/m$^2$.

Sixth layer:

This was a gelatin layer with a gelatin deposit of 1,000 mg/m$^2$.

The silver halide emulsions used in the photosensitive emulsion layers (1st, 3rd and 5th layers) were prepared by the methods shown in Japanese Patent Publication No. 7772/71. These emulsions were chemically sensitized with sodium thiosulfate(pentahydrate) and contained 4-hydroxy-6-methyl-1,3,3a-7-tetrazaindene, bis(-vinylsulfonylmethyl)ether and saponin as stabilizer, hardener and coating aid, respectively. The color paper samples thus prepared were printed and subjected to running processing in an automatic processing machine. The processing schedule and the processing solutions used were as follows.

| Processing schedule: | | |
|---|---|---|
| Steps | Temperature | Time |
| (1) Color development | 33° C. | 3 min and 30 sec |
| (2) Bleack-fixing | 33° C. | 1 min and 30 sec |
| (3) Stabilization | 25–30° C. | 3 min |
| (4) Drying | 75–80° C. | ca. 2 min |

| Color developer (as tank solution): | |
|---|---|
| Components | Amounts |
| Benzyl alcohol | 15 ml |
| Ethylene glycol | 15 ml |

-continued

| | |
|---|---|
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N—ethyl-N—(β-methanesulfonamidoethyl)-aniline sulfate | 5.5 g |
| Brightener (4,4'-diaminostilbene disulfonic acid derivative) | 1.0 g |
| Potassium hydroxide | 2.0 g |
| Water to make | 1,000 ml |

Color developer replenisher A:

| Components | Amounts |
|---|---|
| Benzyl alcohol | 2.0 ml |
| Ethylene glycol | 2.0 ml |
| Potassium sulfite | 3.0 g |
| Potassium carbonate | 30.0 g |
| Hydroxylamine sulfate | 4.0 g |
| Polyphosphoric acid (TPPS) | 3.0 g |
| 3-Methyl-4-amino-N—ethyl-N—(β-methanesulfonamidoethyl)-aniline sulfate | 7.0 g |
| Brightener (4,4'-diaminostilbene disulfonic acid derivative) | 1.5 g |
| Potassium hydroxide | 3.0 g |
| Water to make | 1,000 ml |

Color developer replenisher B:

| Components | Amounts |
|---|---|
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| Hydroxyethoxyiminodiacetic acid | 4.0 g |
| 1-Hydroxy-ethylidene-1,1'-diphosphonic acid | 1.0 g |
| Magnesium chloride | 0.8 g |
| 3-Methyl-4-amino-N—ethyl-N—(β-methanesulfonamidoethyl) aniline sulfate | 7.0 g |
| Brightener (4,4'-diaminostilbene disulfonic acid derivative) | 1.5 g |
| Potassium hydroxide | 3.0 g |
| Water to make | 1,000 ml |

Bleach-fixing bath (as tank solution):

| Components | Amounts |
|---|---|
| Ethylenediaminetetraacetic acid iron (III) ammonium dihydrate salt | 60 g |
| Ethylenediaminetetraacetic acid | 3 g |
| Ammonium thiosulfate (70% sol.) | 100 ml |
| Ammonium sulfite (40% sol.) | 27.5 ml |
| Potassium carbonate or glacial acetic acid to give a pH of 7.1 | |
| Water to make | 1,000 ml |

Bleach-fixing replenisher A:

| Components | Amounts |
|---|---|
| Ethylenediaminetetraacetic acid iron (III) ammonium dihydrate salt | 260 g |
| Potassium carbonate | 42 g |
| Water to make | 1,000 ml |
| pH 6.7 ± 0.1 | |

Bleach-fixing replenisher B:

| Components | Amounts |
|---|---|
| Ammonium thiosulfate (70% sol.) | 500 ml |
| Ammonium sulfite (40% sol.) | 250 ml |
| Ethylenediaminetetraacetic acid | 17 g |
| Glacial acetic acid | 85 ml |
| Water to make | 1,000 ml |
| pH 4.6 ± 0.1 | |

Stabilizing solution A:

| Component | Amount |
|---|---|
| Acetic acid | 0.5 g/1,000 ml |

Stabilizing solution B:

| Components | Amounts |
|---|---|
| 5-Chloro-2-methyl-4-isothiazoline-3-one | 0.05 g/1,000 ml |
| 2-Octyl-4-isothiazoline-3-one | 0.05 g/1,000 ml |

The automatic processor was filled with the color developer (tank solution), bleach-fixing tank solution, and stabilizing solution A or B. While the color paper samples were processed through this automatic processor, the color developer replenisher A or B, bleach-fixing replenishers A and B, and stabilizing solution A or B were fed through metering cups. The color developer A or B was supplied to the color developer tank in an amount of 324 ml per square meter of each color paper; each of the bleach-fixing replenishers A and B was fed into the bleach-fixing tank in an amount of 25 ml per square meter of each color paper; and the stabilizing solution A or B was supplied into the stabilizing tank in an amount of 150 ml per square meter of each color paper. The stabilizing tank in the automatic processor consisted of three stages that were operated in a counter-current fashion. Stabilizing solution A or B was fed into the last (third) stage tank, and an overflow was caused to enter the second stage, and an overflow from this second stage was caused to flow into the first stage.

The running test was conducted until the total amount of the bleach-fixing replenishers A and B used was three times the capacity of the bleach-fixing solution tank.

EXPERIMENT 1

After the running operation, eleven samples of the stabilizing solution each weighing 1,000 ml were taken from each of the three stages of the stabilizing tank. To each of these samples, the formulations identified as Nos. 1 to 21 in Table 1 and as Nos. 22 to 33 in Table 2 were added, and each of the mixtures was adjusted to a pH of 6.0 with KOH and $H_2SO_4$. Color papers prepared as above were color-developed and bleach-fixed as in the processing with the automatic processor. Then, the color papers were sequentially immersed in the mixtures of formulation Nos. 1 to 33 and the solutions in the three stages of the stabilization tank. Thereafter, the papers were recovered from the stabilizing solutions, dried, and held in a constant temperature bath (60° C., 80% r.h.) for 15 days,. The density of the yellow stain on the unexposed area of each paper was measured with an optical densitometer, PDA-65 of Konishiroku Photo Industry Co., Ltd. The results are shown in Tables 3 and 4.

TABLE 1

| Formulation No. | Components and Their Amounts | | |
|---|---|---|---|
| Comparative Samples | | | |
| (1) | None | | |
| (2) | 5-chloro-2-methyl-4-isothiazoline-3-one | | 0.1 g |
| (3) | 1,2-benzoisothiazoline-3-one | | 0.1 g |
| (4) | Chelating agent (7) | | 5 g |
| (5) | Chelating agent (44) | | 5 g |
| (6) | Chelating agent (81) | | 5 g |
| (7) | Chelating agent (81) 5 g | + $CuCl_2$ | 0.5 g |
| (8) | " | + $CrCl_3$ | " " |
| Samples of the Present Invention | | | |
| (9) | " | + $BaCl_2$ | " " |
| (10) | " | + $CaCl_2$ | " " |
| (11) | " | + $Ce(SO_4)_3$ | " " |

TABLE 1-continued

| Formulation No. | Components and Their Amounts | | |
|---|---|---|---|
| (12) | " | + $CoCl_2$ | " " |
| (13) | " | + $InCl_3$ | " " |
| (14) | " | + $LaCl_3$ | " " |
| (15) | " | + $MnCl_2$ | " " |
| (16) | " | + $NiCl_2$ | " " |
| (17) | " | + $PbCl_2$ | " " |
| (18) | " | + $TiCl_3$ | " " |
| (19) | " | + $SnCl_4$ | " " |
| (20) | " | + $ZnSO_4$ | " " |
| (21) | " | + $Zr(SO_4)_2$ | " " |

Formulation Nos. 1 to 21 were used with color developer replenisher A and stabilizing solution A.

TABLE 2

| Formulation No. | Components and Their Amounts | | | |
|---|---|---|---|---|
| Comparative Samples | | | | |
| (22) | None | | | |
| (23) | Citric acid | | | |
| (24) | Chelating agent (7) | 5 g | | |
| (25) | Chelating agent (44) | 5 g | | |
| (26) | Chelating agent (81) | 5 g | | |
| (27) | " | 5 g | + $CuCl_2$ | 1.0 g |
| (28) | " | 5 g | + $CdCl_2$ | 1.0 g |
| (29) | " | 50 g | + $MgSO_4$ | 10.0 g |
| (30) | " | 50 g | + $AlCl_3$ | 10.0 g |
| Samples of the Present Invention | | | | |
| (31) | " | 5 g | + $SrSO_4$ | 1.0 g |
| (32) | " | 5 g | + $AlCl_3$ | 1.0 g |
| (33) | " | 5 g | + $MgSO_4$ | 1.0 g |

Formulation Nos. 22 to 33 were used with color developer replenisher B and stabilizing solution B.

TABLE 3

| Formulation No. | Yellow Stain ( Blue reflection density) | |
|---|---|---|
| | Before Storage | After Storage |
| Comparative Samples | | |
| (1) | 0.06 | 0.45 |
| (2) | " | 0.44 |
| (3) | " | 0.44 |
| (4) | " | 0.44 |
| (5) | " | 0.44 |
| (6) | " | 0.44 |
| (7) | " | 0.49 |
| (8) | " | 0.48 |
| Samples of the Present Invention | | |
| (9) | " | 0.18 |
| (10) | " | 0.13 |
| (11) | " | 0.22 |
| (12) | " | 0.23 |
| (13) | " | 0.24 |
| (14) | " | 0.23 |
| (15) | " | 0.24 |
| (16) | " | 0.26 |
| (17) | " | 0.26 |
| (18) | " | 0.26 |
| (19) | " | 0.20 |
| (20) | " | 0.16 |
| (21) | " | 0.20 |

TABLE 4

| Formulation No. | Yellow Stain (Blue reflection density) | |
|---|---|---|
| | Before Storage | After Storage |
| Comparative Samples | | |
| (22) | 0.06 | 0.41 |
| (23) | " | 0.44 |
| (24) | " | 0.44 |
| (25) | " | 0.44 |
| (26) | " | 0.44 |
| (27) | " | 0.42 |
| (28) | " | 0.43 |
| (29) | " | 0.38 |
| (30) | " | 0.47 |
| Samples of the Present Invention | | |
| (31) | " | 0.22 |
| (32) | " | 0.23 |
| (33) | " | 0.13 |

As Table 3 shows, formulations Nos. 2 and 3 having isothiazoline derivatives added to the stabilizing solution A, and formulation Nos. 4 to 6 having chelating agents added to the stabilizing solution A were ineffective in reducing yellow staining. Formulation Nos. 7 and 8 in which metals other than those claimed in the present invention, as well as a chelating agent were added to the stabilizing solution A were also undesired since they increased yellow staining. On the other hand, formulation Nos. 9 to 21 wherein metals as claimed in the present invention, as well as a chelating agent were added to the stabilizing solution A were highly effective in minimizing the occurrence of yellow staining. Of the metals used, Ba, Ca, Sn, Zn and Zr were preferred, and Ba, Ca and Zr were more preferred. The best results were obtained with Ca.

The formulations tested had no significant difference with respect to the ability to prevent the decrease in dye density. Referring now to Table 4, formulation No. 22 was made of only the stabilizing solution B, formulation No. 23 had citric acid added to the solution B, formulations 24 to 26 had chelating agents added to the solution B, formulation Nos. 27 and 28 had incorporated in the solution B respectively a copper salt and a cadmium salt, both of which were outside the group of the metals claimed in the invention, and in formulation Nos. 29 and 30 water-soluble chelate compounds as claimed in the present invention were incorporated in the solution B but in the amounts outside the range specified in the present invention. All of these formulations were little effective in inhibiting the occurrence of yellow staining during storage.

On the other hand, formulation Nos. 31 to 33 wherein the solution B contained Sr, Al and Mg according to the present invention and a chelating agent in the amounts within the range specified in the present invention were highly effective in preventing the increase in yellow staining during storage. Of these formulations, formulation No. 33 using Mg was the most effective.

As it turned out, using an excessive amount of a water-soluble chelate compound as in formulation Nos. 29 and 30 gave another undesirable result, i.e. tiny crystal grains formed on the surface of the emulsion layer in the dried photographic material.

EXPERIMENT 2

The same procedure of Experiment 1 was repeated for formulation Nos. 34 to 42 shown in Table 5 and formulation Nos. 43 to 51 listed in Table 6. The results are respectively shown in Tables 7 and 8. In the testing with formulation Nos. 34 to 42, color developer replenisher A was used in combination with stabilizing solution A. In the testing with formulation Nos. 43 to 51, color developer replenisher B was used in combination with the stabilizing solution B.

As Table 7 shows, formulation Nos. 36 to 41 using water-soluble chelate compounds of metals as claimed in the present invention were effective in inhibiting the increase in yellow staining. Formulation Nos. 38 to 41 were particularly effective, and the best results were obtained with formulation Nos. 39 and 41 using chelating agent No. 81. Formulation No. 42 contained only a salt of a metal included in the scope of the present invention, but it was entirely ineffective in preventing yellow staining.

As Table 8 shows, formulation Nos. 45 to 50 using water-soluble chelate compounds of Mg included in the scope of the present invention were more effective than formulation Nos. 43 and 44 using citric acid and glycine, respectively. Of these effective formulations, Nos. 47 to 50 were particularly effective, and the best results were obtained with formulation Nos. 48 to 50 using chelating agent No. 81. Formulation No. 51 contained only a Mg salt (no chelating agent), but this was unable to prevent the increase in yellow staining and a precipitate formed in the stabilizing solution. It was therefore clear that using a metal salt alone was not effective in achieving the objects of the present invention.

TABLE 5

| Components | | | Formulation (34) | (35) | (36) | (37) | (38) | (39) | (40) | (41) | (42) |
|---|---|---|---|---|---|---|---|---|---|---|---|
| $CaCl_2$ | | (g) | 1.0 | 1.0 | 1.0 | 1.0 | 1.0 | 1.0 | 0.5 | 0.5 | 0.5 |
| Ortho-phenylphenol | | (g) | 0.05 | 0.05 | 0.05 | 0.05 | 0.05 | 0.05 | — | — | 0.05 |
| 5-chloro-2-methyl-4-isothiazoline-3-one | | (g) | 0.05 | 0.05 | 0.05 | 0.05 | 0.05 | 0.05 | — | — | — |
| Sodium citrate | | (g) | 5 | — | — | — | — | — | — | — | — |
| Glycine | | (g) | — | 5 | — | — | — | — | — | — | — |
| Chelating agent | (5) | (g) | — | — | 5 | — | — | — | — | — | — |
| Chelating agent | (31) | (g) | — | — | — | 5 | — | — | 5 | — | — |
| Chelating agent | (44) | (g) | — | — | — | — | 5 | — | — | — | — |
| Chelating agent | (81) | (g) | — | — | — | — | — | 5 | — | 5 | — |
| | | | Samples of the Present Invention | | | | | | | | Comparative Samples |

TABLE 6

| Components | | | Formulation (43) | (44) | (45) | (46) | (47) | (48) | (49) | (50) | (51) |
|---|---|---|---|---|---|---|---|---|---|---|---|
| $MgCl_2.6H_2O$ | | (g) | 1.0 | 1.0 | 1.0 | 1.0 | 1.0 | 1.0 | 1.0 | 1.0 | 1.0 |
| Ortho-phenylphenol | | (g) | 0.05 | 0.05 | 0.05 | 0.05 | 0.05 | 0.05 | | 0.05 | 0.05 |
| Citric acid | | (g) | 5 | — | — | — | — | — | — | — | — |
| Glycine | | (g) | — | 5 | — | — | — | — | — | — | — |
| Chelating agent | (5) | (g) | — | — | 5 | — | — | — | — | — | — |
| Chelating agent | (31) | (g) | — | — | — | 5 | — | — | — | 2 | — |
| Chelating agent | (44) | (g) | — | — | — | — | 5 | — | — | — | — |
| Chelating agent | (81) | (g) | — | — | — | — | — | 5 | 5 | 3 | — |
| | | | Samples of the Present Invention | | | | | | | | Comparative Samples |

TABLE 7

| Formulation No. | Yellow Stain (Blue reflection density) Before Storage | After Storage |
|---|---|---|
| Samples of the Present Invention | | |
| (34) | 0.06 | 0.32 |
| (35) | " | 0.34 |
| (36) | " | 0.23 |
| (37) | " | 0.25 |
| (38) | " | 0.18 |
| (39) | " | 0.14 |
| (40) | " | 0.19 |

TABLE 7-continued

| Formulation No. | Yellow Stain (Blue reflection density) Before Storage | After Storage |
|---|---|---|
| (41) | " | 0.13 |
| Comparative Samples | | |
| (42) | " | 0.44 |

TABLE 8

| Formulation No. | Yellow Stain (Blue reflection density) Before Storage | After Storage |
|---|---|---|
| Samples of the Present Invention | | |
| (43) | 0.06 | 0.32 |
| (44) | " | 0.32 |
| (45) | " | 0.24 |
| (46) | " | 0.22 |
| (47) | " | 0.17 |
| (48) | " | 0.12 |
| (49) | " | 0.12 |
| (50) | " | 0.14 |
| Comapartive Sample | | |
| (51) | " | 0.42 |

EXAMPLE 2

Color paper samples prepared as in Example 1 were given step exposure and subjected to running processing according to the scheme and with the processing solutions the same as used in Example 1. The stabilizing solution A was used in combination with the formulations A to F shown in Table 9. The color developer tank was supplied with the color developer replenisher A.

The color paper samples thus processed were stored in a constant temperature/humidity bath (60° C., 80% r.h.) for 15 days and the yellow stain that occurred in the unexposed area of each sample was measured with a densitometer PDA-65. The results are shown in Table 10.

For each of the formulations A to F, a 500-ml sample of the stabilizing solution was taken out of the third stage of the stabilization tank. Each of the samples was left to stand at room temperature for 25 days and checked for the formation of a precipitate at 5-day intervals. The results are shown in Table 11.

TABLE 9

| Components | Formulation A | B | C | D | E | F |
|---|---|---|---|---|---|---|
| $CaCl_2$ (g/l) | — | 0.04 | 0.08 | 0.5 | 6.0 | 20.0 |
| Ortho-phenylphenol (g/l) | 0.05 | 0.05 | 0.05 | 0.05 | 0.05 | 0.05 |
| 5-chloro-2-methyl-4-isothiazoline-3-one (g/l) | 0.05 | 0.05 | 0.05 | 0.05 | 0.05 | 0.05 |
| Chelating agent (81) (g/l) | 3.0 | 3.0 | 3.0 | 3.0 | 30.0 | 100.0 |
| pH (adjusted with KOH) | 6.0 | 6.0 | 6.0 | 6.0 | 6.0 | 6.0 |

TABLE 10

| Formulation No. | Yellow Stain Before Storage | After Storage |
|---|---|---|
| Comparative Example | | |
| A | 0.06 | 0.41 |
| Samples of the Present Invention | | |
| B | " | 0.29 |
| C | " | 0.25 |
| D | " | 0.13 |
| E | " | 0.18 |
| F | " | 0.31 |

TABLE 11

| Formulation No. | Appearance of Solution 5 days | 10 days | 15 days | 20 days | 25 days |
|---|---|---|---|---|---|
| Comparative Sample | | | | | |
| A | − | − | + | ++ | ++ |
| Samples of the Present Invention | | | | | |
| B | − | − | − | − | + |
| C | − | − | − | − | ± |
| D | − | − | − | − | − |
| E | − | − | − | − | − |
| F | − | − | − | − | + |

−: Clear and no precipitation
±: Very slight precipitation
+: Some precipitation
++: Extensive precipitation As Table 10 shows, formulation A containing an isothiazoline derivative and a chelating agent was not as effective as formulations B to F in minimizing the increase in yellow staining. Formulations B to F contained a water-soluble chelate compound of a metal in the scope of the present invention in combination with the isothiazoline derivative and chelating agent. The data for these formulations also show that the water-soluble chelate compound according to the present invention (in this case, a calcium salt) exhibited its intended effect when it was used in amounts in the range of $4\times10^{-4}$ to $2\times10^{-2}$ mol.

As Table 11 shows, formulations B to F according to the present invention were also effective in preventing the formation of a precipitate in the stabilizing solution, and hence increasing the long-term stability of that solution.

EXAMPLE 3

Color paper samples prepared as in Example 1 were given in step exposure and subjected to running processing according to the scheme and with the processing solutions the same as used in Example 1. The stabilizing solution B was used in combination with the formulations 52 to 59 shown in Table 12. The color developer tank was supplied with the replenisher B.

The color paper samples thus processed were stored in a constant temperature/humidity bath (60° C., 80% r.h.) for 15 days and the yellow stain that occurred in the unexposed area of each sample was measured with an optical densitometer. The results are shown in Table 13.

For each of the formulations 52 to 59, a 500-ml sample of the stabilizing solution was taken out of the third stage of the stabilization tank. Each of the samples was left to stand at room temperature for 25 days and checked for the formation of a precipitate at 5-day intervals. The results are shown in Table 14.

TABLE 12

| Components | | Formulation (52) | (53) | (54) | (55) | (56) | (57) | (58) | (59) |
|---|---|---|---|---|---|---|---|---|---|
| $MgCl_2.6H_2O$ | (g/l) | — | 0.1 | 0.2 | 0.5 | 1.5 | 4.0 | 5.0 | 7.01 |
| Ortho-phenylphenol | (g/l) | 0.05 | 0.05 | 0.05 | 0.05 | 0.05 | 0.05 | 0.05 | 0.05 |
| 5-chloro-2-methyl-4-isothiazoline-3-one | (g/l) | 0.05 | 0.05 | 0.05 | 0.05 | 0.05 | 0.05 | 0.05 | 0.05 |
| Chelating agent (81) | (g/l) | 3.0 | 3.0 | 3.0 | 3.0 | 3.0 | 6.0 | 10.0 | 10.0 |
| pH (Adjusted with KOH) | | 3.0 | 3.0 | 3.0 | 3.0 | 3.0 | 3.0 | 3.0 | 3.0 |

TABLE 13

| Formulation No. | Yellow Stain Before Storage | After Storage |
|---|---|---|
| Comparative Sample | | |
| (52) | 0.06 | 0.47 |
| Samples of the Present Invention | | |
| (53) | 0.06 | 0.30 |
| (54) | " | 0.25 |
| (55) | " | 0.14 |
| (56) | " | 0.12 |
| (57) | " | 0.18 |
| (58) | " | 0.25 |
| (59) | " | 0.29 |

TABLE 14

| Formulation No. | Appearance of Solution 5 days | 10 days | 15 days | 20 days | 25 days |
|---|---|---|---|---|---|
| Comparative Sample | | | | | |
| (52) | − | − | + | ++ | ++ |
| Samples of the | | | | | |

TABLE 14-continued

| Formulation No. | Appearance of Solution | | | | |
|---|---|---|---|---|---|
| | 5 days | 10 days | 15 days | 20 days | 25 days |
| Present Invention | | | | | |
| (53) | − | − | − | − | + |
| (54) | − | − | − | − | ± |
| (55) | − | − | − | − | − |
| (56) | − | − | − | − | − |
| (57) | − | − | − | − | − |
| (58) | − | − | − | − | ± |
| (59) | − | − | − | − | − |

−: Clear and no precipitation
±: Very slight precipitation
+: Some precipitation
++: Extensive precipitation As Table 13 shows, formulation Nos. 53 to 59 incorporating both a chelating agent and a magnesium salt according to the present invention could minimize the increase in yellow staining much more effectively than did formulation No. 52 using only a chelating agent.

As Table 14 shows, the formulations according to the present invention were also highly effective in preventing the formation of a silver sulfide precipitate in the stabilizing solution, hence improving the long-term stability of that solution.

Tables 13 and 14 also show that the water-soluble chelate compound of a metal within the scope of the present invention exhibited its intended effect when it was used in amounts in the range of $1\times10^{-4}$ to $3.5\times10^{-4}$ mol per liter, especially in the range of $5\times10^{-4}$ to $3\times10^{-2}$ mol per liter. The best results were obtained when the compound was used in amounts in the range of $1\times10^{-3}$ to $2\times10^{-2}$ mol per liter.

EXAMPLE 4

Cyan couplers according to the present invention, C-7, C-11, C-22, C-45 and C-53, as well as three comparative cyan couplers having the structures shown below were added to a mixture consisting of 3 g of a high-boiling point organic solvent (dibutyl phthalate), 18 g of ethyl acetate, and optionally a suitable amount of dimethylformamide. Each of the couplers was used in an amount of 6 g. The resulting mixtures were heated at 60° C. to make uniform solutions. Each of the solutions was added to 100 ml of a 5% aqueous gelatin solution containing 10 ml of a 5% aqueous solution of Alkanol B (alkylnaphthalene sulfonate of E. I. Du Pont), and the resulting mixtures were treated with ultrasonic waves to make dispersions.

Each of the dispersions was added to a silver chlorobromide emulsion (10 mol% silver chloride) in such an amount that it contained the specific cyan coupler in an amount of 10 mol% of the silver. After adding 12 mg of 1,2-bis(vinylsulfonyl)ethane (as hardener) per gram of the gelatin, the resulting coating solution was applied onto a polyethylene coated paper to give a silver deposit of 5 mg/100 cm$^2$. Color paper samples thus prepared were exposed through an optical wedge made of an interference filter (700 mm). The exposed paper samples were given running processing according the scheme and with the processing solutions used in Example 1. Four different stabilizing solutions were used: solution C (control) and solution D (of the present invention) used in Example 2, as well as solution E (control) and solution F (of the present invention) used in Example 3. The discoloration of the cyan dye in each sample was determined by the following procedure: after locating an area having a red reflection density of about 1.0, the sample was exposed to sun-light for 250 hours, and the density of the same area was measured. The results are shown in Tables 15 and 16.

The three comparative couplers had the following structures:

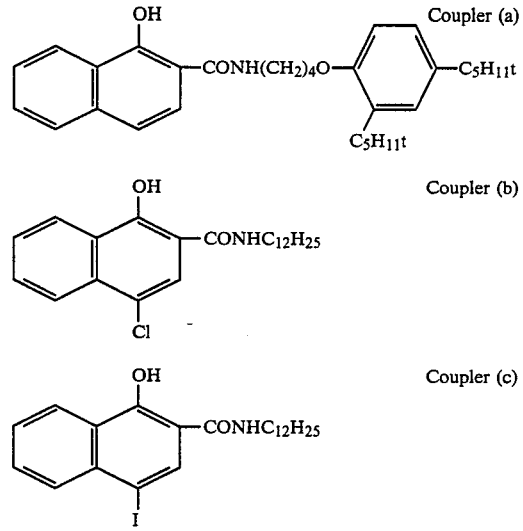

TABLE 15

| Cyan coupler | Discoloration of cyan dye Stabilizing solution | |
|---|---|---|
| | Formulation (C) | Formulation (D) |
| Comparative Samples | | |
| (a) | 31 | 28 |
| (b) | 28 | 27 |
| (c) | 30 | 26 |
| Samples of the Present Invention | | |
| (C-7) | 20 | 11 |
| (C-11) | 21 | 13 |
| (C-22) | 19 | 10 |
| (C-45) | 22 | 14 |
| (C-53) | 20 | 12 |

TABLE 16

| Cyan coupler | Discoloration of cyan dye Stabilizing solution | |
|---|---|---|
| | Formulation (E) | Formulation (F) |
| Comparative samples | | |
| (a') | 31 | 26 |
| (b') | 28 | 25 |
| (c') | 30 | 25 |
| Samples of the Present Invention | | |
| (C-7) | 20 | 10 |
| (C-11) | 21 | 11 |
| (C-22) | 19 | 9 |
| (C-45) | 22 | 11 |
| (C-53) | 20 | 10 |

As Tables 15 and 16 show, the stabilizing solutions according to the present invention were little effective in preventing light discoloration even when they were used together with the comparative cyan couplers. On the other hand, the same stabilizing solutions were able to prevent the increase in light discoloration more effectively than did the control stabilizing solutions when they were used in combination with cyan couplers C-7, C-11, C-22, C-45 and C-53. It is therefore clear that the stabilizing solutions according to the present invention are particularly effective for use with the cyan couplers specified in the present invention.

What is claimed is:

1. A method of processing a silver halide color photographic material which comprises (a) imagewise exposing said material, (b) then developing said material, (c) then treating said material with one of a bleach-fixing solution or a fixing solution, each of said bleach-fixing solution and said fixing solution containing an organic acid iron (III) complex salt, and (d) then, without washing with water, treating said material with a stabilizing solution containing a water-soluble chelate compound of at least one metal selected from a first group consisting of Ba, Ca, Ce, Co, In, La, Mn, Ni, Pb, Ti, Sn, Zn, and Zr, and a second group consisting of Mg, Al, and Sr, wherein said chelate compound of a metal from said first group is present in an amount of $1\times10^{-4}$ to $1\times10^{-1}$ mole per liter of said stabilizing solution and said chelate compound of a metal from said second group is present in an amount of $1\times10^{-4}$ to $3.5\times10^{-2}$ mole per liter of said stabilizing solution.

2. The method of claim 1 wherein said water-soluble chelate compound is a reaction product of (i) at least one metal selected from said first and second group with (ii) a chelating agent having one of Formulas I-VIII $$M_mP_mO_{3m} \qquad \text{I}$$

wherein M is a hydrogen atom, alkali metal or ammonium; and m is an integer of 3 to 6;

$$M_{n+2}P_nO_{3n+1} \qquad \text{II}$$

wherein n is an integer of 2 to 20, M is defined in Formula I;

$$A_1—R_4—Y—R_5—COOH \qquad \text{III}$$

wherein $A_1$ is a hydrogen atom, —OH, COOM, or —$PO_3M_2$, M is as defined in Formula I; $R_4$ and $R_5$ are each an alkylene group; and Y is —N—$R_6$—$A_6$ or —N—$A_6$ wherein $R_6$ is the same as $R_4$ and $R_5$ and $A_6$ is the same as $A_1$;

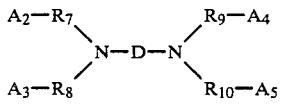

IV wherein D is an alkylene group, cycloalklene group, phenylene group, —$R_6OR_6$—, —$R_6OR_6OR_6$— or —$R_6YR_6$— wherein Y and $R_6$ are as defined above; $R_7$ to $R_{10}$ are each the same as $R_4$ and $R_5$; and $A_2$ to $A_5$ are each the same as $A_1$;

$$R_{11}N(CH_2PO_3M_2)_2 \qquad \text{V}$$

wherein $R_{11}$ is a lower alkyl group, aryl group, aralkyl group, nitrogen-containing 6-membered cyclic group; and M is as defined in Formula I;

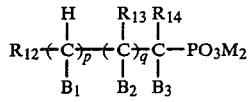

VI wherein $R_{12}$ to $R_{14}$ are each a hydrogen atom, —OH, or a lower alkyl group; $B_1$ to $B_3$ are each a hydrogen atom, —OH, —COOM, —$PO_3M_2$ or —$NJ_2$ wherein J is a hydrogen atom, a lower alkyl, $C_2H_4OH$ or —$PO_3M_2$; M is as defined in Formula I; and p and q are each 0 or 1;

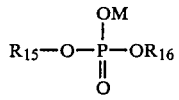

VII wherein $R_{15}$ and $R_{16}$ are each a hydrogen atom, an alkali metal, ammonium, an alkyl group having 1 to 12 carbon atoms, an alkenyl group or a cyclic alkyl group; and M is as defined in Formula I;

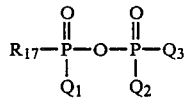

VIII wherein $R_{17}$ is an alkyl group having 1 to 12 carbon atoms, an alkoxy group having 1 to 12 carbon atoms, a monoalkylamino group having 1 to 12 carbon atoms a dialkylamino group having 2 to 12 carbon atoms, an amino group, an aryloxy group having 1 to 24 carbon atoms, an arylamino group having 6 to 24 carbon atoms, or an amyloxy group; $Q_1$ to $Q_3$ each represents —OH, an alkoxy group having 1 to 24 carbon atoms, an aralkyloxy group, aryloxy group, —$OL_3$, amino group, morpholino group, cyclic amino group, alkylamino group, dialkylamino group, arylamino group or alkyloxy group; and L is a cation.

3. The method of claim 2 wherein said chelating agent is of Formula VI.

4. The method of claim 1 wherein said chelate compound is of at least one metal selected from Ba, Ca, Sn, Zn, Zr and Mg.

5. The method of claim 1 wherein the pH of said stabilizing solution is in the range of 0.5 to 10.

6. The method of claim 5 wherein the pH of said stabilizing solution is in the range of 3 to 9.

7. The method of claim 5 wherein the pH of said stabilizing solution is in the range of 6 to 8.

8. The method of claim 1 wherein said water-soluble chelate compound is used in an amount of $4\times10^{-4}$ to $2\times10^{-2}$ mol per liter of said stabilizing solution.

9. The method of claim 8 wherein said water-soluble chelate compound is used in an amount of $8\times10^{-4}$ to $1\times10^{-2}$ mol per liter of the stabilizing solution.

10. The method of claim 1 wherein said water-soluble chelate compound of at least one metal selected from said second group is used in an amount of $1\times10^{-4}$ to $3.5\times10^{-2}$ mol per liter of the stabilizing solution.

11. The method of claim 1 wherein said water-soluble chelate compound is used in an amount of $5\times10^{-4}$ to $3\times10^{-2}$ mol per liter of the stabilizing solution.

12. The method of claim 1 wherein said water-soluble chelate compound is used in an amount of $1\times10^{-3}$ to $2\times10^{-2}$ mol per liter of the stabilizing solution.

13. A method of processing a silver halide color photographic material which comprises (a) imagewise exposing said material, (b) then developing said material, (c) then treating said material with one of a bleach-fixing solution or a fixing solution, and (d) then, without washing with water, treating said material with a stabilizing solution containing a water-soluble chelate compound of at least one metal selected from a first group consisting of Ba, Ca, Ce, Co, In, La, Mn, Ni, Pb, Ti, Sn, Zn, and Zr, and a second group consisting of Mg, Al, and Sr, wherein said silver halide photographic material contains at least one coupler of the following formula C-I or C-II

C-I

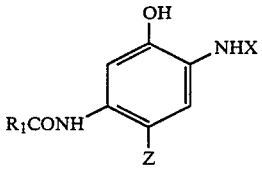

wherein X is —$COR_2$,

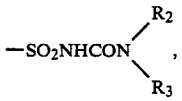

—$CONHCOR_2$ or —$CONHSO_2R_2$ wherein $R_2$ is an alkyl group, alkenyl group, cycloalkyl group, aryl group or a hetero ring; $R_3$ is a hydrogen atom, an alkyl group, alkenyl group, cycloalkyl group, aryl group or a hetero ring; provided that $R_2$ and $R_3$ may combine to form a 5- or 6-membered ring; $R_1$ is a ballast group; and Z is a hydrogen atom or a group that is capable of leaving upon coupling with the oxidized product of an aromatic primary amine color developing agent;

C-II

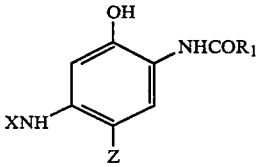

wherein $R_1$, X and Z are defined above.

14. The method of claim 13 wherein said water-soluble chelate compound is a reaction product of (i) at least one metal selected from said first and second group with (ii) a chelating agent having one of Formulas I-VIII $$M_mP_mO_{3m} \quad \text{I}$$

wherein M is a hydrogen atom, alkali metal or ammonium; and m is an integer of 3 to 6;

$$M_{n+2}P_nO_{3n+1} \quad \text{II}$$

wherein n is an integer of 2 to 20, and M is as defined in Formula I;

$$A_1—R_4—Y—R_5—COOH \quad \text{III}$$

wherein $A_1$ is a hydrogen atom, —OH, COOM, or —$PO_3M_2$, M is as defined in Formula I; $R_4$ and $R_5$ are each an alkylene group; and Y is —N—$R_6$—$A_6$ or —N—$A_6$ wherein $R_6$ is the same as $R_4$ and $R_5$ and $A_6$ is the same as $A_1$;

IV

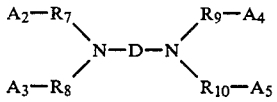

wherein D is an alkylene group, cycloalklene group, phenylene group, —$R_6OR_6$—, —$R_6OR_6OR_6$— or —$R_6YR_6$— wherein Y and $R_6$ are as defined above; $R_7$ to $R_{10}$ are each the same as $R_4$ and $R_5$; and $A_2$ to $A_5$ are each the same as $A_1$;

$$R_{11}N(CH_2PO_3M_2)_2 \quad \text{V}$$

wherein $R_{11}$ is a lower alkyl group, aryl group, aralkyl group, nitrogen-containing 6-membered cyclic group; and M is as defined in Formula I;

VI

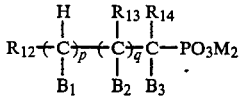

wherein $R_{12}$ to $R_{14}$ are each a hydrogen atom, —OH, or a lower alkyl group; $B_1$ to $B_3$ are each a hydrogen atom, —OH, —COOM, —$PO_3M_2$ or —$NJ_2$ wherein J is a hydrogen atom, a lower alkyl, $C_2H_4OH$ or —$PO_3M_2$; M is as defined in Formula I; and p and q are each 0 or 1;

VII

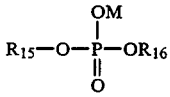

wherein $R_{15}$ and $R_{16}$ are each a hydrogen atom, an alkali metal, ammonium, an alkyl group having 1 to 12 carbon atoms, an alkenyl group or a cyclic alkyl group; and M is as defined in Formula I;

VIII

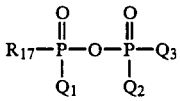

wherein $R_{17}$ is an alkyl group having 1 to 12 carbon atoms, an alkoxy group having 1 to 12 carbon atoms, a monoalkylamino group having 1 to 12 carbon atoms a dialkylamino group having 2 to 12 carbon atoms, an amino group, an aryloxy group having 1 to 24 carbon atoms, an arylamino group having 6 to 24 carbon atoms, or an amyloxy group; $Q_1$ to $Q_3$ each represents —OH, an alkoxy group having 1 to 24 carbon atoms, an aralkyloxy group, aryloxy group, —$OL_3$, amino group, morpholino group, cyclic amino group, alkylamino group, dialkylamino group, arylamino group or alkyloxy group; and L is a cation.

15. The method of claim 13 wherein said coupler of Formula C-I or C-II is of Formula XIV, XV, or XVI:

XIV

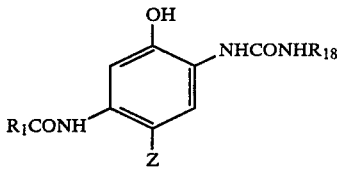

wherein $R_1$ is a ballast group; $R_{18}$ is an aryl group; and Z is a hydrogen atom or a group that is capable of leaving upon coupling with the oxidized product of an aromatic primary amine color developing agent;

XV

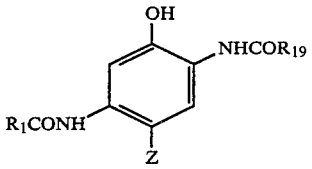

wherein $R_1$ is as defined above; $R_{19}$ is an alkyl group having 1 to 20 carbon atoms, an alkenyl group having 2 to 20 carbon atoms, a cycloalkyl group having a 5- to 7-membered ring, an aryl group or a heterocyclic group; and Z is as defined above;

XVI

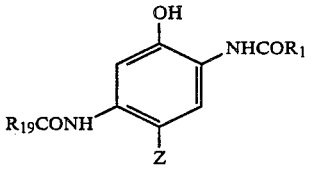

wherein $R_1$, $R_{19}$ and Z are as defined above.

16. The method of claim 15 wherein $R_{18}$ in said Formula XIV is a phenyl group that is substituted by at least one member selected from among $-SO_2R_{20}$, halogen atom, $-CF_3$, $-NO_2$, $-CN$, $-COR_{20}$, $-COOR_{20}$, $-SO_2OR_{20}$,

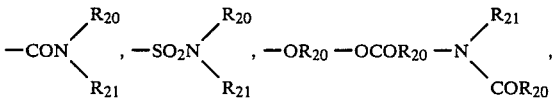

-continued

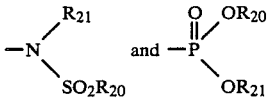

wherein $R_{20}$ is an alkyl group having 1 to 20 carbon atoms, an alkenyl group having 2 to 20 carbon atoms, a cycloalkyl group having a 5- to 7-membered ring or a phenyl group; and $R_{21}$ is a hydrogen atom or the same as $R_{20}$.

17. The method of claim 15 wherein said $R_1$ ballast group in said Formula XIV is of Formula XVII:

XVII

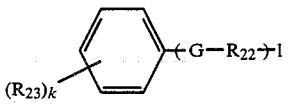

wherein G is an oxygen atom, sulfur atom or a sulfonyl group; $R_{22}$ is an alkylene group having 1 to 20 carbon atoms; $R_{23}$ is a monovalent group; k is an integer of 0 to 4; and l is an integer of 0 to 1; provided that when k is 2 or more, $R_{23}$ may be the same or different.

18. The method of claim 17 wherein said $R_{23}$ monovalent group in said Formula XVII is a group selected from a hydrogen atom, a halogen atom, an alkyl group having 1 to 20 carbon atoms, a phenyl group, a heterocyclic group, an alkoxy group having 1 to 20 carbon atoms, a phenoxy group, a hydroxy group, an acyloxy group, a carboxy group, an alkyloxycarbonyl group having 1 to 20 carbon atoms, an aryloxycarbonyl group, an alkylthio group having 1 to 20 carbon atoms, an acyl group, an acylamino group having 1 to 20 carbon atoms, a sulfonamide group, a carbamoyl group and a sulfamoyl group.

19. The method of claim 13 wherein the pH of said stabilizing solution is in the range of 0.5 to 10.

20. The method of claim 13 wherein said water-soluble chelate compound of at least one metal selected from said first group is used in an amount of $1\times10^{-4}$ to $1\times10^{-1}$ mol per liter of said stabilizing solution.

21. The method of claim 13 wherein said water-soluble chelate compound of at least one metal selected from said second group is used in an amount of $1\times10^{-4}$ to $3.5\times10^{-2}$ mol per liter of the stabilizing solution.

22. The method of claim 13 wherein said water-soluble chelate compound is used in an amount of $5\times10^{-4}$ to $3\times10^{-2}$ mol per liter of the stabilizing solution.

23. The method of claim 13 wherein said water-soluble chelate compound is used in an amount of $1\times10^{-3}$ to $2\times10^{-2}$ mol per liter of the stabilizing solution.

* * * * *

REEXAMINATION CERTIFICATE (1064th)

United States Patent [19]

Kurematsu et al.

[11] B1 4,537,856

[45] Certificate Issued May 30, 1989

[54] METHOD OF PROCESSING SILVER HALIDE COLOR PHOTOGRAPHIC MATERIALS

[75] Inventors: Masayuki Kurematsu, Hachioji; Shigeharu Koboshi, Sahamihara, both of Japan

[73] Assignee: Konishiroku Photo Industry Co., Ltd., Tokyo, Japan

Reexamination Request:
No. 90/001,401, Dec. 18, 1987

Reexamination Certificate for:

| | |
|---|---|
| Patent No.: | **4,537,856** |
| Issued: | **Aug. 27, 1985** |
| Appl. No.: | **596,871** |
| Filed: | **Apr. 5, 1984** |

[30] Foreign Application Priority Data

Apr. 5, 1983 [JP] Japan ..... 58-58692

Apr. 7, 1983 [JP] Japan ..... 58-59980

[51] Int. Cl.[4] ..... G03C 7/40

[52] U.S. Cl. ..... 430/372; 430/393; 430/430; 430/432; 430/552; 430/553

[58] Field of Search ..... 430/372, 432, 430, 552, 430/553, 393

[56] References Cited

FOREIGN PATENT DOCUMENTS 71402 2/1983 European Pat. Off. .

*Primary Examiner*—Mukund J. Shah

[57] ABSTRACT

A method of processing a silver halide color photographic material is disclosed. The material is treated with a bleach-fixing solution or a fixing solution, and then, without washing with water, treated with a stabilizing solution incorporating a water-soluble chelate compound of at least one metal selected from the group consisting of Ba, Ca, Ce, Co, In, La, Mn, Ni, Pb, Ti, Sn, Zn and Zr and the group consisting of Mg, Al and Sr.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDENT ARE PRINTED HEREIN.

Column 1, line 24:
8542/82, 132146/82, [14834/82] *14834/83* and 18631/83 (the sym-

AS A RESULT OF REEXAMINATION, IT HAS BEEN DETERMINED THAT:

Claims 1 and 13 are determined to be patentable as amended.

Claims 2–12 and 14–23, dependent on an amended claim, are determined to be patentable.

1. A method of processing a silver halide color photographic material which comprises
(a) imagewise exposing said material,
(b) then developing said material,
(c) then treating said material with one of a bleach-fixing solution or a fixing solution, each of said bleach-fixing solution and said fixing solution containing an organic acid iron (III) complex salt, and
(d) then, without washing with water, treating said material with a stabilizing solution containing a water-soluble chelate compound of at least one metal selected from *either* a first group consisting of Ba, Ca, Ce, Co, In, La, Mn, Ni, Pb, Ti, Sn, Zn, and Zr, *or* [and] a second group consisting of Mg, Al, and Sr, wherein said chelate compound of a metal from said first group is present in an amount of $1\times10^{-4}$ to $1\times10^{-1}$ mole per liter of said stabilizing solution and said chelate compound of a metal from said second group is present in an amount of $1\times10^{-4}$ to $3.5\times10^{-2}$ mole per liter of said stabilizing solution.

13. A method of processing a silver halide color photographic material which comprises
(a) imagewise exposing said material,
(b) then developing said material,
(c) then treating said material with one of a bleach-fixing solution or a fixing solution, and
(d) then, without washing with water, treating said material with a stabilizing solution containing a water-soluble chelate compound of at least one metal selected from *either* a first group consisting of Ba, Ca, Ce, Co, In, La, Mn, Ni, Pb, Ti, Sn, Zn, and Zr, *or* [and] a second group consisting of Mg, Al, and Sr, wherein said silver halide photographic material contains at least one coupler of the following formula C-I or C-II

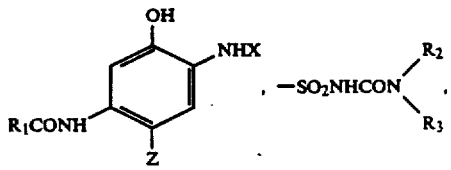

wherein X is $COR_2$ $—CONHCOR_2$ or $—CONHSO_2R_2$ wherein $R_2$ is an alkyl group, alkenyl group, cycloalkyl group, aryl group or a hetero ring; $R_3$ is a hydrogen atom, an alkyl group, alkenyl group, cycloalkyl group, aryl group or a hetero ring; provided that $R_2$ and $R_3$ may combine to form a 5- or 6-membered ring; $R_1$ is a ballast group; and Z is a hydrogen atom or a group that is capable of leaving upon coupling with the oxidized product of an aromatic primary amine color developing agent;

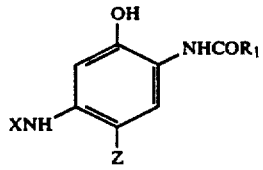

wherein $R_1$, X and Z are defined above.

* * * * *